US005276385A

United States Patent [19]

Itoh et al.

[11] Patent Number: 5,276,385

[45] Date of Patent: Jan. 4, 1994

[54] HIGH-PRESSURE DISCHARGE LAMP AND LIGHTING METHOD

[75] Inventors: Akira Itoh; Kazuyoshi Okamura, both of Yokohama; Kazuiki Uchida, Fujisawa; Mitsuho Kotabe, Yokohama; Hirochika Shiohama, Yokosuka; Kimihito Sato, Yamato; Yasuki Mori, Yokosuka; Katsusuke Uchino, Yokohama, all of Japan

[73] Assignee: Toshiba Lighting & Technology Corporation, Tokyo, Japan

[21] Appl. No.: 765,244

[22] Filed: Sep. 25, 1991

[30] Foreign Application Priority Data

Sep. 25, 1990 [JP] Japan ..... 2-251725
Mar. 29, 1991 [JP] Japan ..... 3-91666

[51] Int. Cl.[5] ..... H01J 7/44

[52] U.S. Cl. ..... 315/73; 315/60; 315/88; 315/161; 315/250; 315/258; 315/289; 315/324; 315/336

[58] Field of Search ..... 315/35, 60, 88, 73, 315/161, 250, 251, 258, 261, 263, 283, 289, 290, 324, 325, 335, 336, 357

[56] References Cited

U.S. PATENT DOCUMENTS 3,211,952 10/1965 McMullen ..... 315/283
3,275,885 9/1966 Pomfrett ..... 315/261
4,135,114 1/1979 Narikiyo ..... 315/289
4,238,711 12/1980 Wallot ..... 315/289
4,287,454 9/1981 Feuersanger et al. ..... 315/178
4,513,227 4/1985 Labadini et al. ..... 315/290
4,958,103 9/1990 Jacobs et al. ..... 313/25
5,028,845 7/1991 Ravi et al. ..... 315/324

FOREIGN PATENT DOCUMENTS 0030730 6/1981 European Pat. Off. .
0240066 10/1987 European Pat. Off. .

*Primary Examiner*—Robert J. Pascal
*Assistant Examiner*—Michael B. Shingleton
*Attorney, Agent, or Firm*—Cushman, Darby & Cushman

[57] ABSTRACT

The invention provides a high-pressure discharge lamp incorporating an outer envelope storing a pair of electric terminals a plurality of arc tubes which are respectively stored in this outer envelope and electrically connected in parallel, and a plurality of ignition aids available for assisting operating of these arc tubes, where these ignition aids are provided for each of these arc tubes and contain potentials different from each other. In addition, the invention also provides a lighting system for operating the high-pressure discharge lamp. The lighting system comprises the first and second power supply lines which respectively provides mutual connection between a pair of terminals of the high-pressure discharge lamp, a ballast which is at least provided for either of the first and second power supply lines, a power switch which is provided for either the first or the second power supply line, a pulse generating means which generates either the positive or the negative ignition pulses to be superimposed on AC power voltage output from an AC power supply source, and a control circuit which alters polarity of the ignition pulses output from the pulse generator.

3 Claims, 23 Drawing Sheets

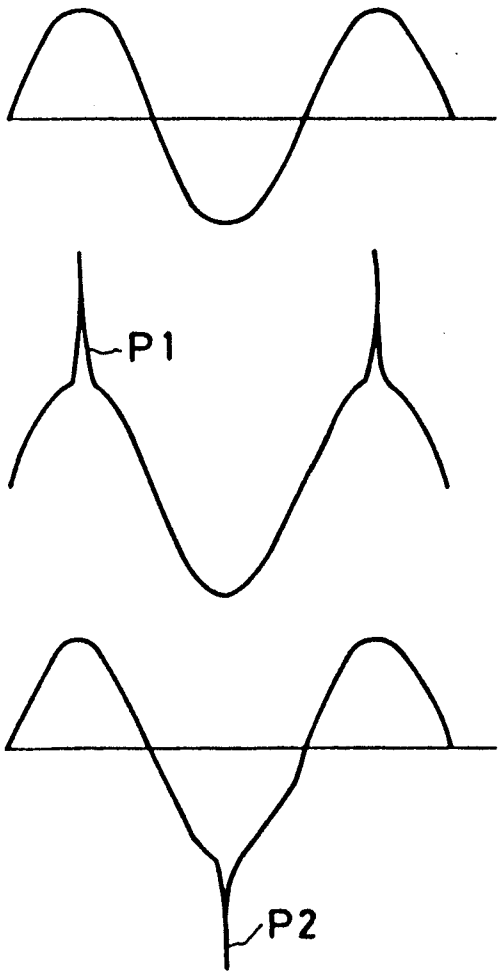
FIG. 9A A.C POWER SUPPLY
FIG. 9B P(+)
FIG. 9C P(−)

| ANGLE | CROSS | PARALLEL |
|---|---|---|
| 0 | 100 | 100 |
| 45 | 100 | 100 |
| 90 | 100 | 100 |
| 135 | 98 | 40 |
| 180 | 93 | 40 |
| 225 | 97 | 94 |
| 270 | 100 | 100 |
| 315 | 100 | 100 |

F I G. 24

HIGH-PRESSURE DISCHARGE LAMP AND LIGHTING METHOD

BACKGROUND OF THE INVENTION

1. Field of the Invention

The present invention relates to a high-pressure discharge lamp incorporating a plurality of arc tubes in the outer envelope and the method of operating.

2. Description of the Related Art

During the operation of a high-pressure metal vapor discharge lamp like a high-pressure sodium lamp or a metal halide lamp, for example, normally the internal pressure of the arc tube rises beyond 1 atmospheric pressure. As a result, after once turning the above mentioned discharge lamp off, in order to again light up the discharge lamp, the controller needs to wait a certain period of time to initiate discharge until the arc tube is cooled off to some extent allowing the mercury and luminous metal to condensate and decrease pressure in the arc tube. For example, in order to re-start a high-pressure sodium lamp with an external ignitor, normally it takes about one minute. On the other hand, in order to reactivate a metal halide lamp, normally it takes more than 10 minutes, and yet, even after being reactivated, at least several minutes are required until the luminous output is fully stabilized.

As a result, when power service is momentarily interrupted, unlike an incandescent lamp or a fluorescent lamp capable of quickly reaching full luminous condition, an interval of at least 10 minutes is required for any conventional high-pressure metal vapor discharge lamps before it can again recover full luminous power.

To solve this problem, as is typically described in the publication of U.S. Pat. No. 4,287,454, a high-pressure sodium lamp is provided, which comprises a pair of arc tubes in an outer envelope which are electrically connected in parallel with each other. When the proposed high-pressure sodium lamp normally lights up, one arc tube in the pair of arc tubes remains lit. When power service is resumed after a momentary interruption, the other arc tube containing a low pressure lights up. In this case, while the former arc tube remains lit, the latter arc tube has a slightly raised internal pressure due to the preliminarily applied heating effect. As a result, this arc tube can start and reach its full output in a few minutes. In other words, the high-pressure sodium lamp cited above fully restarts in a very short period of time, thus offering much convenience for constantly illuminating highways and tunnels.

Furthermore, even when one of the arc tubes cannot light up itself, the other arc tube lights up. This in turn significantly extends the life of the high-pressure sodium lamp cited above. Theoretically, the service life of this high-pressure sodium lamp is twice as long as that of a conventional high-pressure sodium lamp merely housing a single arc tube.

On the other hand, when operating such a high-pressure sodium lamp incorporating a pair of parallel connected arc tubes in the outer envelop, the arc tube in the pair of arc tubes which has a lower starting voltage lights up. In other words, due to unexpected irregularities incidental to the manufacturing process, starting voltages may be slightly uneven between the two arc tubes. As a result, the arc tube with the lower starting voltage lights up first. Hence, when activating the high-pressure sodium lamp cited above, either one of the arc tubes, whichever has a lower starting voltage, always lights up first. In other words, whenever operating the high-pressure sodium lamp with a pair of arc tubes cited above, the arc tube with the lower starting voltage tends to light up first. This means that the arc tube with a lower starting voltage often light up itself, thus resulting in dissipation of the sodium filled in this arc tube. If this symptom occurs, then the lamp voltage of the arc tube rises to cause the luminous characteristic of the lamp itself to quickly degrade.

When either of these arc tube is no longer available, the other one can be operated. Since one arc tube of the pair of the arc tubes cannot instantaneously light up again, the high-pressure sodium lamp can no longer maintain the objective discussed above.

Mostly, the rise of voltage in the arc tube accounts for the generation of disabled arc tubes caused by unilateral operating. Consequently, during the latter half of the service life of the high-pressure sodium lamp, the arc tube that tends to initially light up frequently extinguishes. When this arc tube is extinct, the other arc tube starts lighting up in turn. After the former arc tube is subject to repeated extinction, leakage eventually occurs in it, thus causing the rare gas in it to leak into the outer envelope. As a result, the leaked rare gas absorbs the ignition pulse to prevent the other arc tube from being activated. For example, even when the arc tube is operated, as a result of heat dissipation by the rare gas, neither temperature nor voltage rises in the arc tube, thus lowering luminous efficiency. In the same way, the high-pressure discharge lamp incorporating a plurality of arc tubes is adversely affected by those symptoms described above.

Summary of the Invention

Therefore, an object of the present invention is to provide a novel high-pressure discharge lamp which can securely maintain for a long time its own functional capability of instantaneously irradiating light by alternately activating a plurality of arc tubes on halves to prevent either half of the plural arc tubes from constantly being subject to operation, and at the same time, the present invention also provides a method of lighting up the high-pressure discharge lamp of the present invention.

According to the present invention, a high-pressure discharge lamp and the method of properly operating this discharge lamp are respectively provided, wherein the discharge lamp comprises an outer envelope which incorporates a pair of terminals; a high-pressure discharge lamp which is stored in the outer envelope and incorporates a plurality of arc tubes electrically connected to the terminals in parallel; an AC power-supply source; first and second power-supply lines which respectively connect both terminals of the AC power-supply source to a pair of terminals of the high-pressure discharge lamp; a ballast which is at least provided for either of said first and second power-supply lines; a power switch which is provided for either the first or the second power-supply line; a pulse generating means which generates either the positive or the negative ignition pulses to be superimposed on the AC power voltage delivered from the AC power-supply source; and a control means which alters the polarity of the ignition pulses output from the pulse generating means.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate the presently preferred embodiments of the invention, and together with the general description given above and the detailed description of the preferred embodiments given below, serve to explain the principles of the invention.

FIG. 9A is a diagram showing the waveform of AC power-supply source available for a third embodiment of the present invention;

FIG. 9B is a diagram showing the positive ignition pulse voltage P (+) available for a third embodiment of the present invention;

FIG. 9C is a diagram showing the negative ignition pulse voltage P (−) available for a third embodiment of the present invention;

FIG. 24 is a chart showing the uneven light distribution when a plurality of arc tubes are disposed by way of intersecting each other and in parallel with each other;

DETAILED DESCRIPTION OF THE PREFERRED EMBODIMENTS

Figure 1:
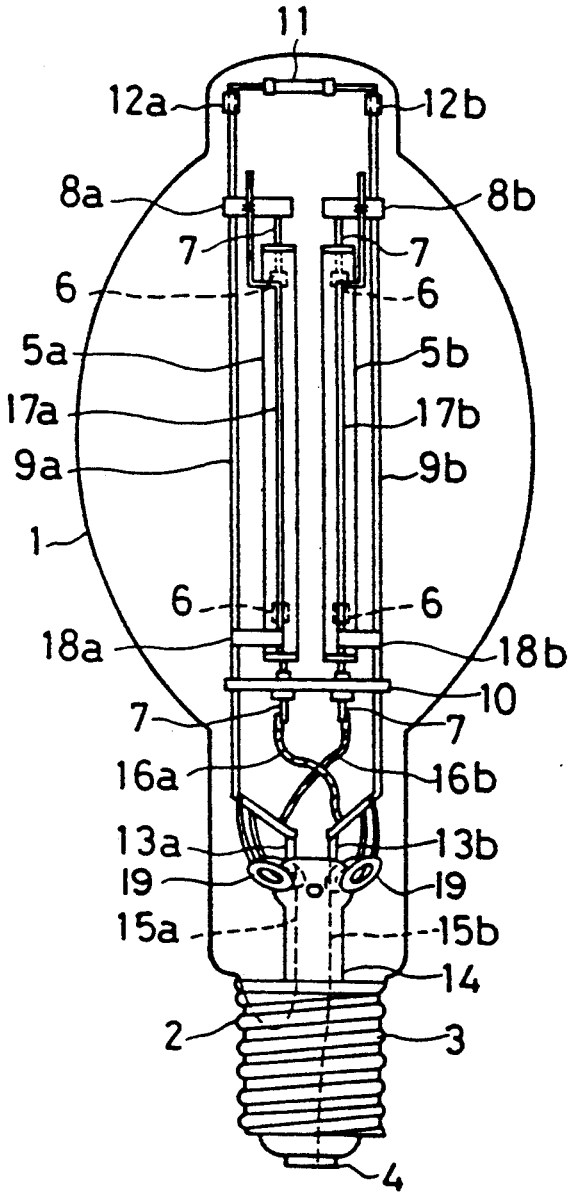
FIG. 1 is a diagram of the front view of the whole structure of the high-pressure discharge lamp according to a first embodiment of the present invention.
Figure 2:
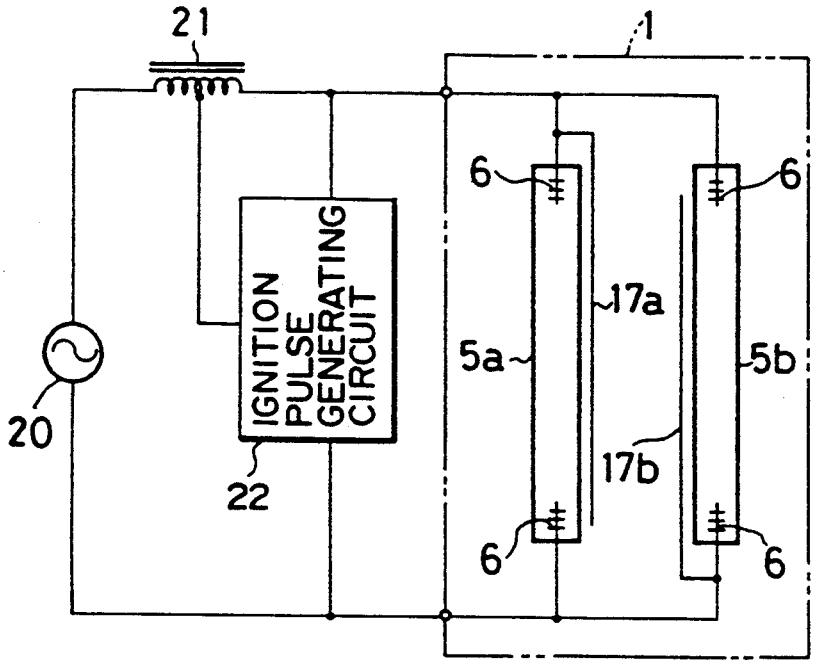
FIG. 2 is a block diagram of the operation circuit according to a first embodiment of the present invention.
Figure 3:
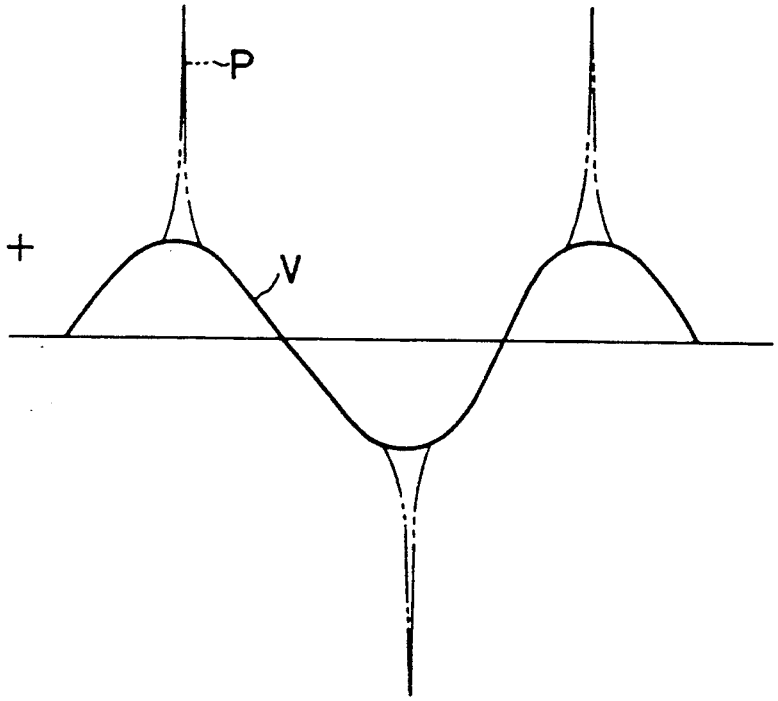
FIG. 3 is a graph of the ignition pulse waveforms generated from a first embodiment of the present invention.

Referring now more particularly to FIGS. 1 through 3, the high-pressure discharge lamp according to the first embodiment of the present invention is described below. FIG. 1 is a front view of the high-pressure discharge lamp according to the first embodiment. FIG. 2 is a schematic block diagram of the operation circuit according to the first embodiment. Refer now to FIG. 1. The reference numeral 1 designates an outer envelope incorporating a unit of high-pressure sodium lamp. The outer envelope 1 is composed of glass which is of BT shape, where a screw base 2 is supported to an end of the outer envelope 1. The screw base 2 is of the Edison base which is provided with a shell 3 and an eye-let terminal 4.

The outer envelope 1 incorporates a pair of arc tubes 5*a* and 5*b* and is internally filled with N2 gas which prevents arc discharge from being generated in the outer envelope 1 otherwise caused by accidental leakage of gas from these arc tubes 5*a* and 5*b*.

The arc tubes 5*a* and 5*b* are respectively composed of the following: See FIG. 1. An end disk made from alumina ceramic serving as shielding wall is airtightly sealed to an end of tubular light-transmitting envelope made from polycrystalline or monocrystalline alumina.

Main discharge terminals 6 shown in FIG. 2 are respectively supported to a pair of conductive members 7 which are respectively installed by way of penetrating through the end disk. Each of these arc tubes 5a and 5b is filled with sodium, mercury, and Xenon gas.

The conductive members 7 shown at the upper position of FIG. 1 are respectively connected to a pair of bulb holders 8a and 8b made from heat-resistant metal like niobium or tantalum by way of an electrical and mechanical connection. The two arc tubes 5a and 5b are installed in parallel with each other inside the outer envelope 1. The bulb holders 8a and 8b are respectively connected to supporting wires 9a and 9b via both edges. The bottom-side conductive members 7 are respectively held by an insulated holder 10 whose ends are supported to the supporting wires 9a and 9b.

The supporting wires 9a and 9b are respectively conductive. The upper edges of the supporting wires 9a and 9b are connected to each other via an insulated bridge 11, and yet, these upper edges of the supporting wires 9a and 9b are respectively engaged with the top region of the outer envelope 1 via a pair of elastic plates 12a and 12b. On the other hand, the bottom edges of the supporting wires 9a and 9b are respectively supported to lead-in conductors 13a and 13b by means of welding, and the lead-in conductors 13a and 13b are respectively supported to a stem 14 of the outer envelope 1. The shield-supporting lines 13a and 13b are respectively connected to the shell 3 and the eye-let terminal 4 of the screw base 2 via external conductive lines 15a and 15b.

The conductive member 7, below the arc tube 5a, is connected to the supporting wire 9b via a lead wire 16a, and the other conductive member 7, below the other arc tube 5b, is connected to the other support wire 9a via the other lead wire 16b.

A pair of ignition aids 17a and 17b are available for assisting lighting-ignition operation and are respectively provided in an axial direction outside the arc tubes 5a and 5b. The ignition aids 17a and 17b are respectively provided on the external surfaces of the arc tubes 5a and 5b. The upper ends of the ignition aids 17a and 17b are rotatably held by the bulb holders 8a and 8b. The bottom ends are respectively connected to bimetallic elements of the bimetal switches 18a and 18b by means of welding. Likewise, the bimetallic elements of the bimetal switches 18a and 18b are respectively supported to the supporting wires 9a and 9b by means of welding. The reference numeral 19 designates a getter. The inner space of the outer envelope 1 is constantly maintained at 10-4 torr vacuum condition. The high-pressure discharge lamp composed of the above structure is made available by way of connection to the operation circuit shown in FIG. 2.

Since the lighting control circuit is conventionally known in conjunction with a choke-coil type ballast 21 connected to the AC power-supply source 20, description of the lighting control circuit shown in FIG. 2 is deleted. On the other hand, the lighting control system is provided with a ignition pulse generator 22 which is installed in association with the ballast 21. Concretely, according to the embodiments of the invention, the ignition pulse generator 22 generates a specific ignition pulse voltage on both ends of the ballast 21. An independent pulse transformer may also be provided for the ignition pulse generator 22 in order to feed pulses from the transformer to the arc tubes. This method is well known by those who are skilled in the art. The high-pressure discharge lamp embodied by the invention externally uses the choke-coil type ballast 21 and the ignition pulse generator 22 to provide their own functional effect.

When activating the high-pressure discharge lamp, as shown in FIG. 3, the lighting control circuit respectively superimposes pulses P generated on both ends of the ballast 21 by the ignition pulse generator 22 onto AC the voltage V delivered from the AC power-supply source 20 before feeding the superimposed pulses to the arc tubes 5a and 5b.

Before activating the arc tubes 5a and 5b, since the lamps are still cold, the bimetal pieces 18a and 18b respectively bring the ignition aids 17a and 17b to positions close to the arc tubes 5a and 5b.

Next, as shown in FIG. 3, before activating the arc tubes 5a and 5b, the lighting control circuit superimposes ignition pulses P onto the AC voltage V in order to feed the superimposed pulses to the arc tubes 5a and 5b. Specifically, high-voltage pulses are added to the positive and negative components of the AC voltage V. This in turn means that the ignition pulses are generated every half cycle. When a negative pulse is delivered to either of those ignition aids 17a and 17b, the arc tube close to the pulse-added ignition aid is easily activated. For example, when the positive pulse is delivered to the eye-let terminal 4 of the screw base 2, the ignition aid 17a turns negative, and as a result, this activates the arc tube 5a close to the ignition aid 17a. Conversely, when a positive pulse is delivered to the shell 3 of the screw base 2, the other ignition aid 17b turns negative, thus activating the other arc tube 5b close to the ignition aid 17b.

In this way, the ignition aids 17a and 17b respectively receive positive pulses based on 50% of probability. Consequently, the arc tubes 5a and 5b can respectively be operated based on 50@ of probability as well.

However, relative to the increase of the lighting rounds, the rate of operation between both arc tubes is evenly levelled off, and as a result, neither of the arc tubes can unilaterally and intensively be operated.

This in turn prevents either of the arc tubes from unilaterally being activated too often. As a result, the high-pressure discharge lamp embodied by the present invention effectively prevents voltage in either of the arc tubes from sharply rising as a result of promoted dissipation of the sodium in either of the arc tubes and also prevents either of the arc tubes from quickly degrading its own luminous characteristic. Substantially, the arc tubes can extend own service life to double that of any conventional high-pressure discharge lamp merely incorporating a single arc tube.

Furthermore, in the event that either of the arc tubes under illumination is turned off as a result of a momentary power interruption, and then the power service is resumed, the other arc tube having a low pressure and which thus far remained off, lights up. Since the latter arc tube contains heat preliminarily provided by the former arc tube while being lit, the internal pressure of the latter arc tube is slightly raised in advance, and as a result, the luminous condition of the latter tube is stabilized in a very short period of time. As a result, the high-pressure discharge lamp embodied by the present invention can securely restart in a very short period of time. Since the predetermined luminosity can quickly be restored, using the high-pressure discharge lamp embodied by the present invention to illuminate highways and tunnels promotes traffic safety.

When either of the arc tubes 5a and 5b lights up, the bimetallic element of bimetal switches 18a and 18b are thermally deformed to cause the ignition aids 17a and 17b to leave the arc tubes 17a and 17b. This in turn minimizes the interception of radiant light emitted from either of the arc tube 5a end 5b by the presence of the ignition aids 17a and 17b. The above description has referred to such a case in which the first embodiment solely provides the ignition pulse generator outside of the high-pressure discharge lamp. However, the scope of the invention is not merely confined to this. The invention also provides for such a structure as shown in FIG. 4 in a second embodiment of the present invention.

Figure 4:
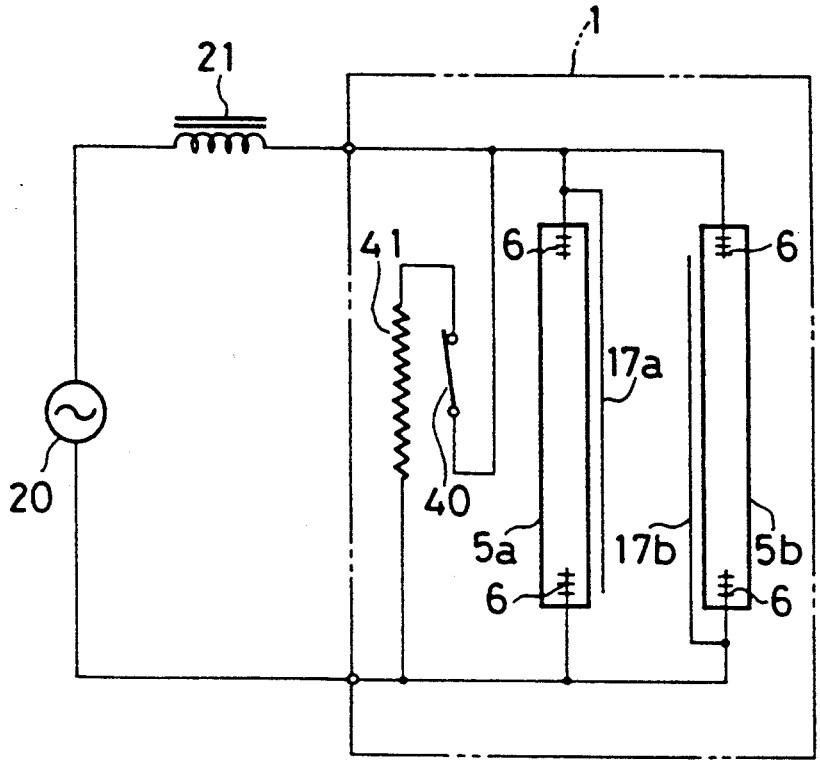
FIG. 4 is a circuit block diagram of the high-pressure discharge lamp incorporating a starter according to a second embodiment of the present invention.

FIG. 4 designates the structure which solely stores the ignition pulse generator inside of the outer envelope 1. This ignition pulse generator is composed of a thermosensitive switch like a bimetal switch 40 and a heater 41, which are connected to each other in series. This serial circuit is connected to a pair of arc tubes 5a and 5b in parallel.

When the high-pressure discharge lamp is activated, the bimetal switch 40 remains closed to feed power to the heater 41, which then thermally opens the bimetal switch 40 to cause the ballast 21 to generate kick voltage pulses. These pulses are then superimposed on the power voltage.

Likewise, the ignition pulse generator composed of the bimetal switch 40 and the heater 41 generates positive and negative high-voltage pulses every half cycle of the AC voltage. Consequently, the arc tubes 5a and 5b respectively feed the positive pulses to the ignition aids 17a and 17b based on 50% of probability, and therefore, the arc tubes 5a and 5b are respectively operated at 50% probability.

Figure 5:
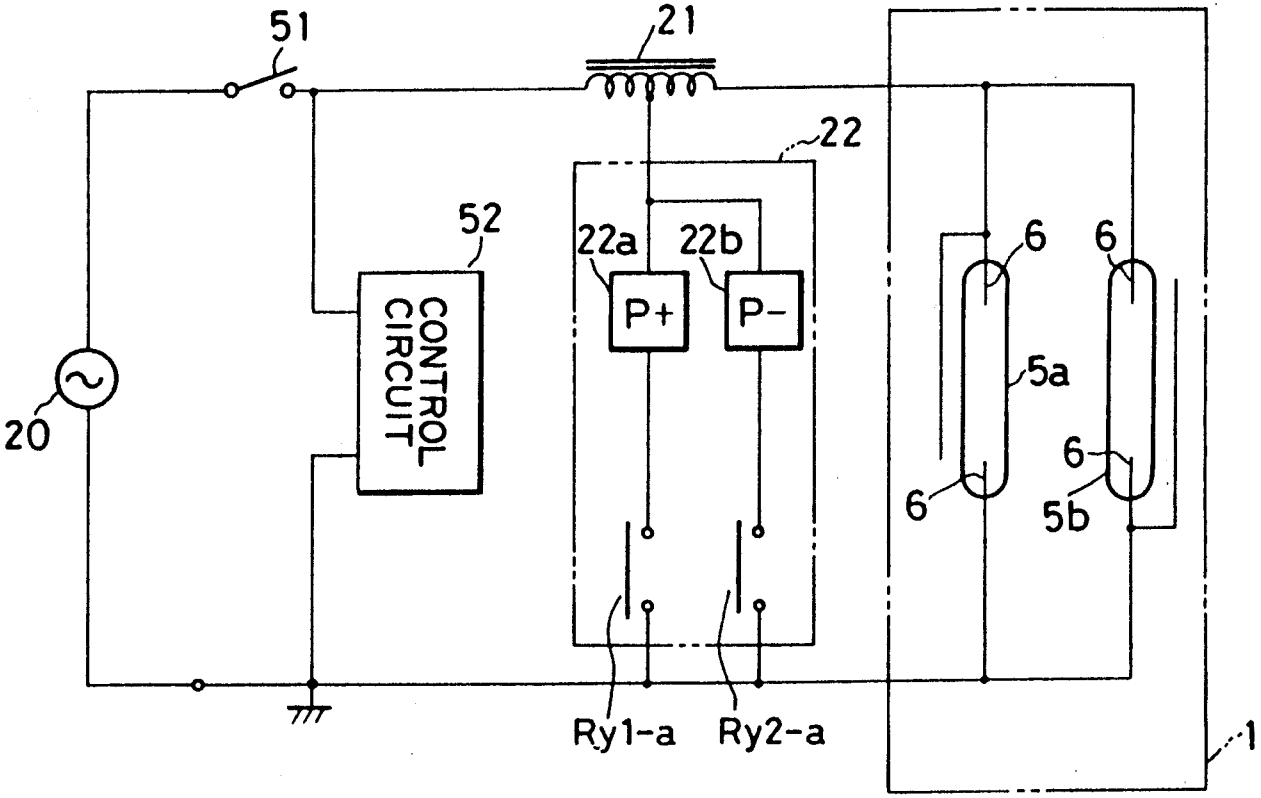
FIG. 5 is a diagram of the operating circuit of the high-pressure discharge lamp according to a third embodiment of the present invention.
Figure 6:
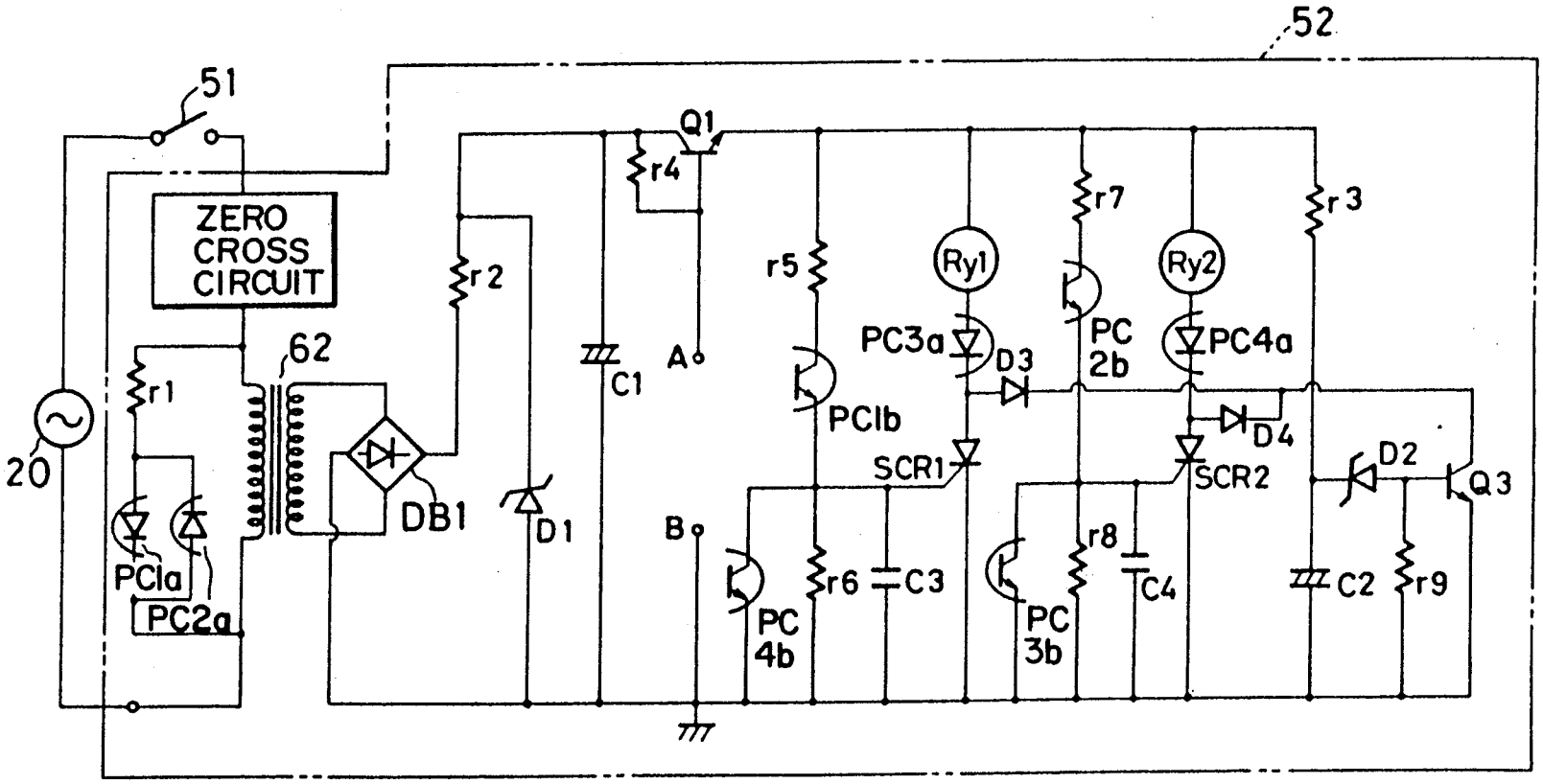
FIG. 6 is a circuit diagram of the lamp operating control circuit according to a third embodiment of the present invention.
Figure 7A:
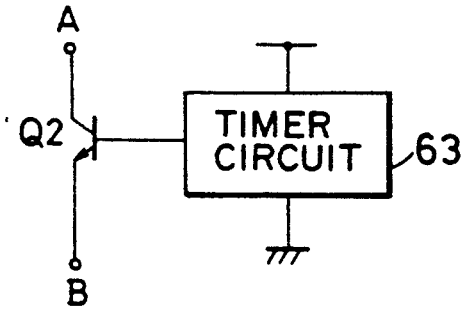
FIG. 7A is a diagram of the timer circuit according to a third embodiment of the present invention.
Figure 7B:
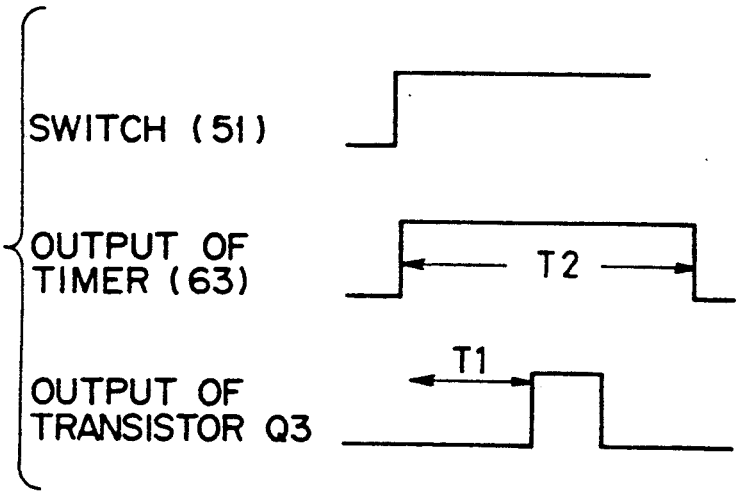
FIG. 7B is a diagram of the waveforms output from the timer circuit according to a third embodiment of the present invention.
Figure 8:
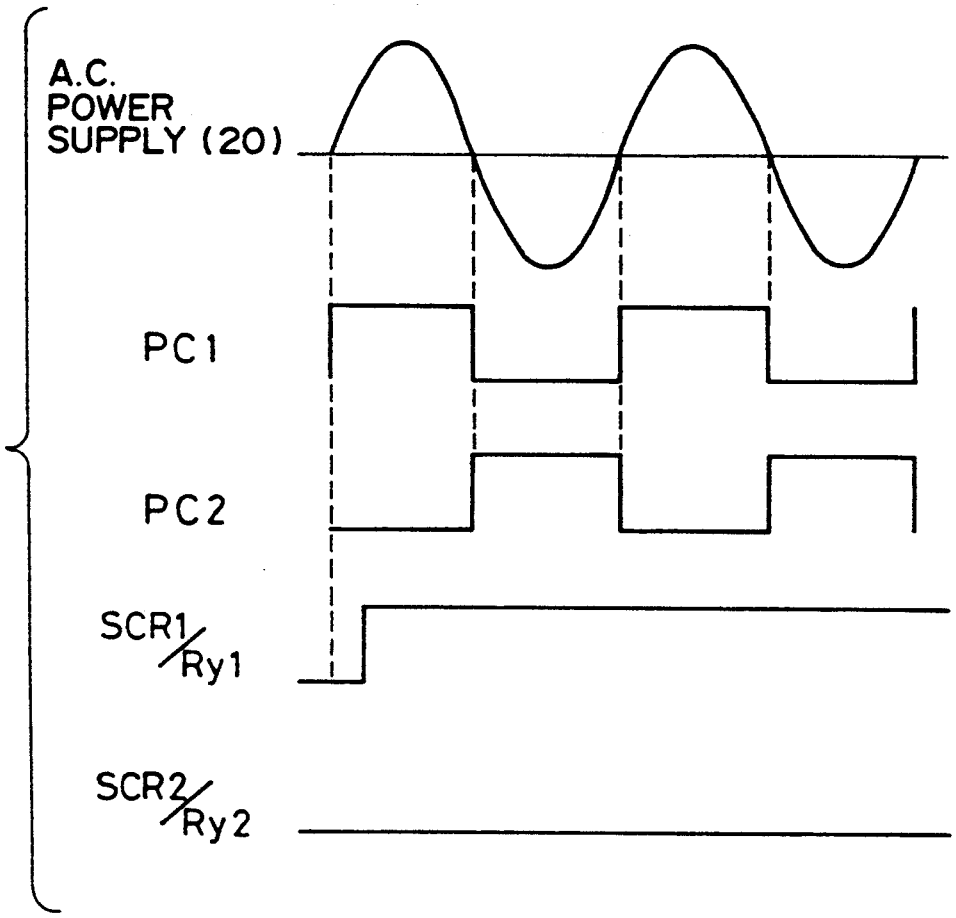
FIG. 8 is a timing chart explaining the lighting operation executed by a third embodiment of the present invention.

Referring now to FIGS. 5 through 9, the high-pressure discharge lamp according to the third embodiment of the present invention is described below. FIG. 5 is a schematic circuit block diagram of the high-pressure discharge lamp having a structure identical to that shown in FIG. 1 which is combined with the lighting control circuit. FIG. 6 is a schematic circuit diagram which further details the lighting control circuit shown in FIG. 5. FIG. 7A is a diagram of a timer circuit and FIG. 7B is a graph of the output waveform of the timer circuit shown in conjunction with another timer circuit. FIG. 8 is a timing chart which explains the functional operation of the lighting control circuit. FIGS. 9A through 9C respectively are graphs of the waveforms of the AC power-supplier and the waveforms of the AC voltage superimposed with ignition pulses output from the ignition pulse generator. Note that the components shown in FIG. 5, which are identical to those shown in FIG. 2, are respectively designated by the identical reference numerals, and a description of these is deleted here.

In the third embodiment of the present invention, the ignition pulse generator 22 activates operation of the ballast 21 to selectively output the positive and negative ignition pulses based on the control operation performed by the lighting controller. In particular, the lighting controller selectively outputs the positive and negative ignition pulses in correspondence with the polarity of the AC power at the moment the power switch is turned ON.

As shown in FIG. 5, the ignition pulse generator 22 incorporates a pair of pulse generators 22a and 22b. The pulse generator 22a outputs the positive pulse P1, shown in FIG. 9A, and the other pulse generator 22b outputs the negative pulse P2, shown in FIG. 9B, respectively. One end of the pulse generators 22a and 22b are respectively connected to an intermediate point of the ballast 21, whereas the other end is respectively grounded via contact Ry1-a of relay Ry1 and another contact Ry2-a of relay Ry2. As shown in FIG. 5, a lighting control circuit 52 is connected to both ends of the AC power-supply source 20 via the power switch 51.

Referring now to FIG. 6, the detailed structure of the lighting control circuit 52 is described below. An end of the AC power-supply source is connected to an end of the primary coil of a transformer 62 via the power switch 51 and a zero-cross circuit 61. The other end of the primary coil is connected to the other end of the AC power-supply source 20. Furthermore, both ends of the primary coil of the transformer are serially connected to a parallel circuit composed of a pair of photocouplers PC1a and PC2a which are respectively connected to a resistor r1. Photocouplers PC1a and PC2a are arranged so that they have an inverted polarity with respect to each other. Both ends of the secondary coil of the transformer 62 are respectively connected to the input terminal of a diode bridge DB1. Another resistor r2 and a Zener diode D1 are respectively connected to the output terminal of the diode bridge DB1 in series. A capacitor Cl is connected to both ends of the Zener diode D1. An end of the capacitor Cl is connected to the collector of transistor Q1, whereas the emitter of this transistor Q1 is grounded via a serial circuit composed of another resistor r3 and another capacitor C2.

Another resistor r4 is connected between the collector and the base of the transistor Q1. Furthermore, as shown in FIG. 7, collector and emitter of another transistor Q2 are respectively connected to terminal A, which is connected to the base of the transistor Q1 and the grounded terminal B. As shown in FIG. 7B, the base of the transistor Q2 is connected to the output terminal of a timer 63 which outputs a HIGH signal for a predetermined period T2 after the power switch 51 is turned ON. As a result, the terminals A and B are connected to each other only for the predetermined period T2 after the power switch 51 is ON. The timer 63 provides the preset period T2, which is longer than the time actually needed to fully light up either of the arc tubes 5a and 5b. A period of 3 minutes, for example, may be used.

The emitter of the transistor Q1 is grounded via the coil of the relay Ry1, photocoupler PC3a, and a thyristor SCR1. A non-grounded terminal of the resistor r6 is connected to the gate of the thyristor SCR1.

On the other hand, emitter of the transistor Q1 is grounded via resistor r7, photocoupler PC2b and a parallel circuit consisting of photocoupler PC3b, resistor r8, and capacitor C4. The emitter of the transistor Q1 is also grounded via the coil of the relay Ry2, photocoupler PC4a, and thyristor SCR2. The non-grounded terminal of the resistor r8 is connected to the gate of the thyristor SCR2.

The contact between the resistor r3 and the capacitor C2 is grounded via the Zener diode D2 and another resistor r9. A non-grounded terminal of the resistor r9 is connected to the base of another transistor Q3, and the emitter is grounded. Diodes D3 and D4 are connected to each other in the forward direction on the contact lines between the photocoupler PC4a and the thyristor SCR1 and between the photocoupler PC3a and the thyristor SCR1 extended from the collector of the transistor Q3.

Next, the functional operation of the control circuit according to the third embodiment of the invention is described below. First, when the AC power switch 51 is ON, as shown in FIG. 8, either the photocoupler PC1a or photocoupler PC2a alternately turns ON corresponding to the actual polarity of the AC power-supply source 20. After the AC power switch 51 is ON, terminals A and B shown in FIG. 7A are shorted for the predetermined period T2. In the event that the photocoupler PC1a initially turns itself ON simultaneous with the operating of the power switch 51, the control circuit according to the third embodiment of the present invention performs the operations described below.

When the photocoupler PC1a turns itself ON, simultaneously the photocoupler PC1b also turns itself ON. As a result, a trigger signal is generated by the non-grounded terminal of the resistor r6 to cause the thyristor SCR1 to also turn itself ON. This excites the coil of the relay Ryl to close contact Ryl-a of the relay Ryl shown in FIG. 5. This permits the positive ignition pulse voltage P (+) to be delivered to both ends of the high-pressure discharge lamp 1. The positive ignition pulse voltage P (+) is generated as a result of the superimposition of the positive pulse P1 output from the pulse generator 22*a* onto the AC voltage V. This permits the arc tube 5*b* to light up. Incidentally, when the coil of the relay Ryl is excited, the photocoupler PC3a turns itself ON. As a result, both ends of the resistor r8 are shorted to cause the trigger signal to be delivered to the gate of the thyristor SCR2 to inhibit this thyristor SCR2 from turning itself ON. In other words, after exciting the coil of the relay Ryl, in the course of feeding the positive ignition pulse voltage P (+) to both ends of the high-pressure discharge lamp 1, excitation of the coil of the relay Ry2 is inhibited to prevent the negative ignition pulse voltage P (−) from being delivered to both ends of the high-pressure discharge lamp 1.

On the other hand, in the event that the photocoupler PC2a initially turns itself ON immediately after activating the power switch 51, the control circuit according to the third embodiment executes the functional operations described below.

When the photocoupler PC2a turns itself ON, the photocoupler PC2b also turns itself ON. As a result, a trigger signal is generated by the non-grounded terminal of the resistor r8 to turn the thyristor SCR2 ON. This excites the coil of the relay Ry2 to close contact Ry2-a of the relay Ry2. This in turn permits the negative ignition pulse voltage P (−) to be delivered to both ends of the high-pressure discharge lamp 1. The negative ignition pulse voltage P (−) is generated as a result of the superimposition of the negative pulse P2 output from the ballast 21, via the function of the pulse generator 22*b*, onto the AC voltage V. This permits the arc tube 5*a* to light up. Incidentally, when the coil of the relay Ry2 is excited, the photocoupler PC4a turns itself ON. As a result, both ends of the resistor r6 are shorted via PC4b to permit a trigger signal to be delivered to the gate of the thyristor SCR1 to inhibit the thyristor SCR1 to turn itself ON. In other words, after exciting the coil of the relay Ry2, in the course of feeding the negative ignition pulse voltage P (−) to both ends of the high-pressure discharge lamp 1, excitation of the coil of the relay Ryl is inhibited to prevent the positive ignition pulse voltage P (+) form being delivered to both ends of the high-pressure discharge lamp 1.

The preset period T1 shown in FIG. 7B is determined by the time constant of the resistor r3 and the capacitor C2. When the preset period T1 is past after turning the transistor Q1 ON, the transistor Q3 turns itself ON. As a result, coils of those relays Ryl and Ry2 are respectively excited to close the contacts of the relays Ry1-a and Ry2-a.

Owing to this functional mechanism, even when the arc tube 5*b* cannot light up itself as a result of the initial excitation of the coil of the relay Ryl resulting in the delivery of the positive ignition pulse voltage P (+) to both ends of the high-pressure discharge lamp 1, the negative ignition pulse voltage P (−) is securely delivered to both ends of the high-pressure discharge lamp 1 to light up the other arc tube 5*a*. In the event that both the arc tubes 5*a* and 5*b* cannot be lit even when feeding the positive and negative pulse voltages P (+) and P (−) to the high-pressure discharge lamp 1, the terminals A and B are opened after passing the preset period T2 from the moment at which the power switch 51 is activated. As a result, the transistor Q1 turns itself OFF to free the coils of the relays Ry1 and Ry2 from the excited condition. This in turn prevents the terminals 6 from incurring unwanted damage otherwise caused by unnecessarily feeding both the positive and negative ignition pulse voltages P (+) and P (−) to the high-pressure discharge lamp 1.

In other words, according to the third embodiment of the invention, whenever the power switch 51 is ON, either the photocoupler PC1a or the photocoupler PC2a can be activated at 50% of probability. Based on this reason, if the polarity of the ignition aids provided for each arc tube were preliminarily arranged to be inverse from each other, and since the available ignition pulses respectively contain 50% of probability, the two arc tubes 5*a* and 5*b* can proportionally be activated based on a 50% probability. This in turn securely prevents either of the two arc tubes from unilaterally being lit up all the time, but instead, the operation of both tubes can evenly be levelled off. In other words, this securely prevents either of these arc tubes from quickly degrading its own luminous characteristic, but instead, the service life can be enhanced. As a result, the two arc tubes can securely and fully exert the intended function to instantaneously light up themselves after a momentary power interruption until their expected service life fully expires.

Furthermore, the control circuit according to the third embodiment of the invention securely feeds both the positive and negative ignition pulse voltages P (+) and P (−) to the high-pressure discharge lamp 1 after passing the preset period T1 from the moment at which the power switch 51 is activated. This in turn permits one of those two arc tubes to securely light up itself even when the other arc tube cannot be lit up.

According to the control circuit provided for the third embodiment, either the positive ignition pulse voltage P (+) or the negative ignition pulse voltage P (−) shown in FIG. 9B and 9C is delivered to both ends of the high-pressure discharge lamp 1 in correspondence with the actual polarity of the AC power-supply source 20 simultaneous with the operating of the power switch 51 so that either the arc tube 5*a* or the other arc tube 5*b* can securely light up itself. The control circuit of the third embodiment then feeds both the positive and negative ignition pulse voltages P (+) and P (−) to the high-pressure discharge lamp 1 after the passing of the preset period T1 from the moment at which the power switch 51 is activated so that either of these two arc tubes can securely light up itself even when one of these arc tubes cannot be lit up.

Consideration is now given to a specific case in which, after activating the power switch 51, the positive ignition pulse voltage P (+) is delivered to both ends of the high-pressure discharge lamp in correspondence with the polarity of the AC power-supply source 20. Then, after confirming that one of the two arc tubes does not light up, the power switch 51 is turned OFF before the preset period T1 has past, and then the power switch is turned ON again. It is probable that, as a result of reactivating the power switch 51, the positive ignition pulse voltage p (+) may be delivered to the high-pressure discharge lamp 1 in a rare Case. Likewise, as a result of reactivating the power switch 51 over again, the positive ignition pulse voltage P (+) may incidentally be delivered to both ends of the high-pressure discharge lamp 1. If the identical pulse voltage were repeatedly delivered to a arc tube that does not light up, the terminals 6 will soon incur unwanted damage. To prevent this, the control circuit of the third embodiment internally provides the positive ignition pulse voltage P (+) with counter swing voltage waveform undershooting itself into the negative region like the one shown in FIG. 10B. This securely lights up either of these arc tubes even when one of these does not light up. As shown in FIG. 10C, the counter swing voltage has an absolute value above the voltage B capable of illuminating the extinct arc tube independent of polarity in the course of the lighting, extinction, and lighting cycle. The absolute value of the counter swing voltage can be set below the voltage A which is the voltage capable of securely lighting up one of the arc tubes with any polarity when either of the arc tubes are lit from the extinct condition.

Figure 10A:
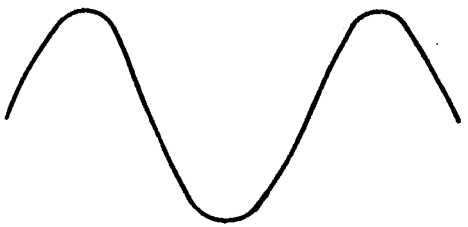
FIG. 10A is a diagram showing the waveform of AC power-supply source available for a third embodiment of the present invention.
Figure 10B:
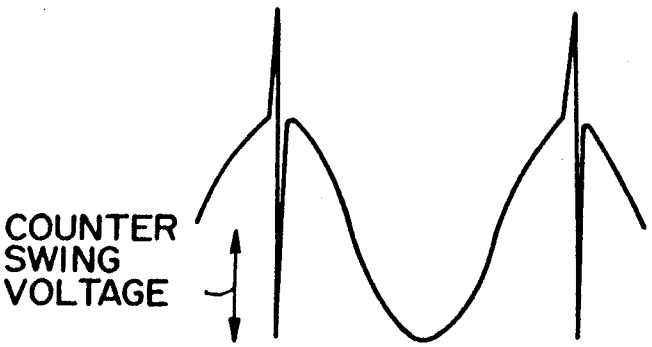
FIG. 10B is a diagram showing the waveform of the counter swing voltage available for a third embodiment of the present invention.
Figure 10C:
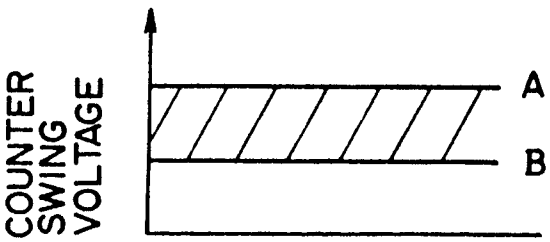
FIG. 10C shows the magnitude of the counter swing voltage available for a third embodiment of the present invention.

The case shown in FIG. 10B adds the counter swing voltage to the positive ignition pulse voltage P (+). However, it is also possible for the third embodiment of the invention to add the counter swing voltage to the negative ignition pulse voltage P (−). Although not shown in the accompanying drawings, the counter swing voltage value can be set by initially determining the constants of the capacitor of the ignition pulse generator 22 and the inductance of the ballast 21 before eventually determining the resonant frequency.

In this way, since the third embodiment adds the counter swing voltage to the positive ignition pulse voltage P (+), and yet, in the event that one of those arc tubes does not light up itself, the other arc tube can securely be lit by means of the counter swing voltage. As a result, this system prevents the positive ignition pulse voltage P (+) from repeatedly being delivered to the extinct arc tube, thus eventually preventing those terminals 6 from incurring unwanted damage. By virtue of this arrangement, even when one of those two arc tubes cannot light up itself, the other arc tube can securely and instantaneously be reactivated for illumination, thus securely extending the service life of the high-pressure contained electric discharge lamp itself.

Figure 11:
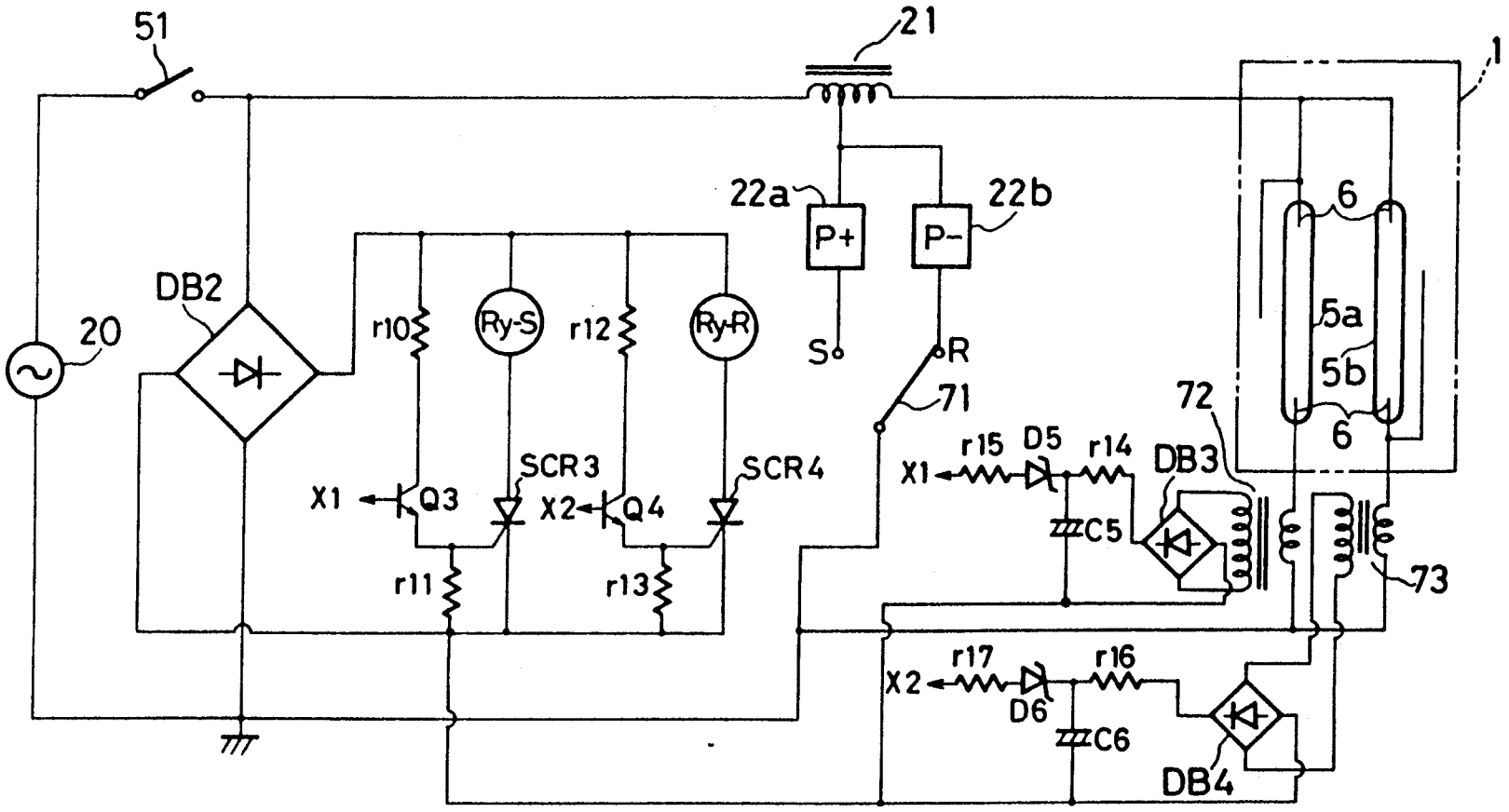
FIG. 11 is a circuit diagram of the operation circuit introduced to the high-pressure discharge lamp according to a fourth embodiment of the present invention.

Referring now to FIG. 11, the fourth embodiment of the present invention is described below. Note that the components shown in FIG. 11 which are identical to those shown in FIGS. 4 and 5 are respectively designated by the identical reference numerals, and thus, description of these is deleted here. See FIG. 11. Both ends of the AC power-supply source 20 are respectively connected to input terminals of a diode bridge DB2 via a power switch 51. A serial circuit consisting of a coil of a latching relay Ry-S and a thyristor SCR3 and another serial circuit consisting of a coil of the other latching relay Ry-R and a thyristor SCR4 are respectively connected to the output terminal of the diode bridge DB2 in parallel.

A resistor r10, transistor Q3, and an emitter resistor r11, are respectively connected to the output terminal of the diode bridge DB2 in series. The emitter of the transistor Q3 is connected to the gate of the thyristor SCR3. In addition, a resistor r12, transistor Q4, and an emitter r13, are respectively connected to the output terminal of the diode bridge DB2 in series. The emitter of transistor Q4 is connected to the gate of the thyristor SCR4.

One end of the pulse generator 22*a* externally delivering the positive pulse P1 is connected to the intermediate point of the ballast 21, and the other end is connected to contact S of the latching relay Ry-S. One end of the other pulse generator 22*b* externally delivering the negative pulse P2 is also connected to the intermediate point of the ballast 21, whereas the other end is connected to contact R of the latching relay Ry-R. The movable contact of relay switch 71 of the latching relay Ry-R is connected to the AC power-supply source 20 and the grounding terminal of the diode bridge DB2. Normally, the relay switch 71 remains closed at contact R.

The main terminals 6 on the lower part of the arc tube 5*a* are connected to the AC power-supply source 20 and the grounding terminal of the diode bridge DB2 via the primary coil of transformer 72. The secondary coil of this transformer 72 is connected to the input terminal of another diode bridge DB3. A resistor r14 and a capacitor C5 are connected to the output terminal of the diode bridge DB3 in series. The contact between the resistor r14 and the capacitor C5 is connected to the base of the transistor Q3 via a Zener diode D5 and a resistor r15.

Likewise, the main terminals 6 on the upper part of the arc tube 5*b* are connected to the AC power-supply source 20 and the grounding terminal of the diode bridge DB3 via the primary coil of another transformer 73. The secondary coil of the transformer 73 is connected to the input terminal of another diode bridge DB4. A resistor r16 and a capacitor C6 are connected to the output terminal of the diode bridge DB4 in series. The contact between the resistor r16 and the capacitor C6 is connected to the base of the transistor Q4 via a Zener diode D6 and a resistor r17.

Next, the functional operation of the control circuit according to the fourth embodiment of the present invention is described below. When the power switch 51 is ON, the negative pulse P2 is superimposed on the AC power voltage output from the AC power-supply source 20, and then delivered to both ends of the high-pressure discharge lamp 1. This cause the arc tube 5*a* to light up. When the arc tube 5*a* lights up, the lamp current flows through the primary coil of the transformer 72, and the AC voltage generated by the secondary coil is delivered to the diode bridge DB3, which then rectifies the full waveforms of the received AC voltage. The wave-rectified voltage is then smoothed by the resistor r14 and then capacitor C5. The smoothed voltage at the contact between the resistor 14 and the capacitor C5 is delivered to the base of the transistor Q3 via the Zener diode D5 and the resistor r15. As a result, the transistor Q3 is turned ON, and a trigger signal is output to the gate of the thyristor SCR3. This in turn 5 activates the thyristor SCR3 to excite the coil of the latch relay Ry-8. In response to this, the relay switch 71 is closed by way of switching itself to contact S, and then this condition is held on. When the power switch 51 is opened after lighting up the arc tube 5*a*, the arc tube 5*a* turns itself OFF.

Next, when the power switch 51 is gain activated, and since the relay switch 71 remains closed on the part of contact S, the AC voltage output from the AC power-supply source 20 is superimposed with the positive pulse Pl, and then the positive-pulse added AC voltage is delivered to both ends of the high-pressure discharge lamp 1 to light the arc tube 5*b*. When the arc tube 5*b* lights up, the lamp current flows through the primary coil of the transformer 73, and the AC voltage generated by the secondary coil of this transformer 73 is delivered to the diode bridge DB4, which then fully rectifies the waveform of the input AC voltage. Next, the rectified waveforms of the AC voltage are smoothed by the resistor r16 and the capacitor C6. The smoothed AC voltage at the contact between the resistor r16 and the capacitor C6 is delivered to the base of the transistor Q4 via the Zener diode D6 and the resistor r17. As a result, the transistor Q4 turns itself ON, and then a trigger signal is output to the gate of the thyristor SCR4. This in turn activates the thyristor SCR4 to excite the coil of the latching relay Ry-R. In response to this, the relay switch 71 is closed by way of switching itself to contact R, and then this condition is held on.

The fourth embodiment of the present invention causes the control system to detect lamp current via the transformers 72 and 73 in order to detect the lit-up arc tube. Instead of using these transformers, the fourth embodiment may also provide a plurality of photoelectric conversion elements in specific position close to these arc tubes in order to convert the light beams emitted from the lit-up arc tube into electric signals. In addition, the fourth embodiment may also provide a thermosensor adjacent to each arc tube in order to detect the actually lit-up arc tube.

According to the fourth embodiment of the invention, whenever the power is ON, the arc tubes 5*a* and 5*b* alternately light up, and thus, the lighting probability of these arc tubes 5*a* and 5*b* can evenly be levelled off at 50%. This in turn significantly extends the service life of the electric discharge lamp itself. Theoretically, the service life of the electric discharge lamp embodied by the invention doubles the service life of any conventional electric discharge lamp merely incorporating a single arc tube.

Figure 12:
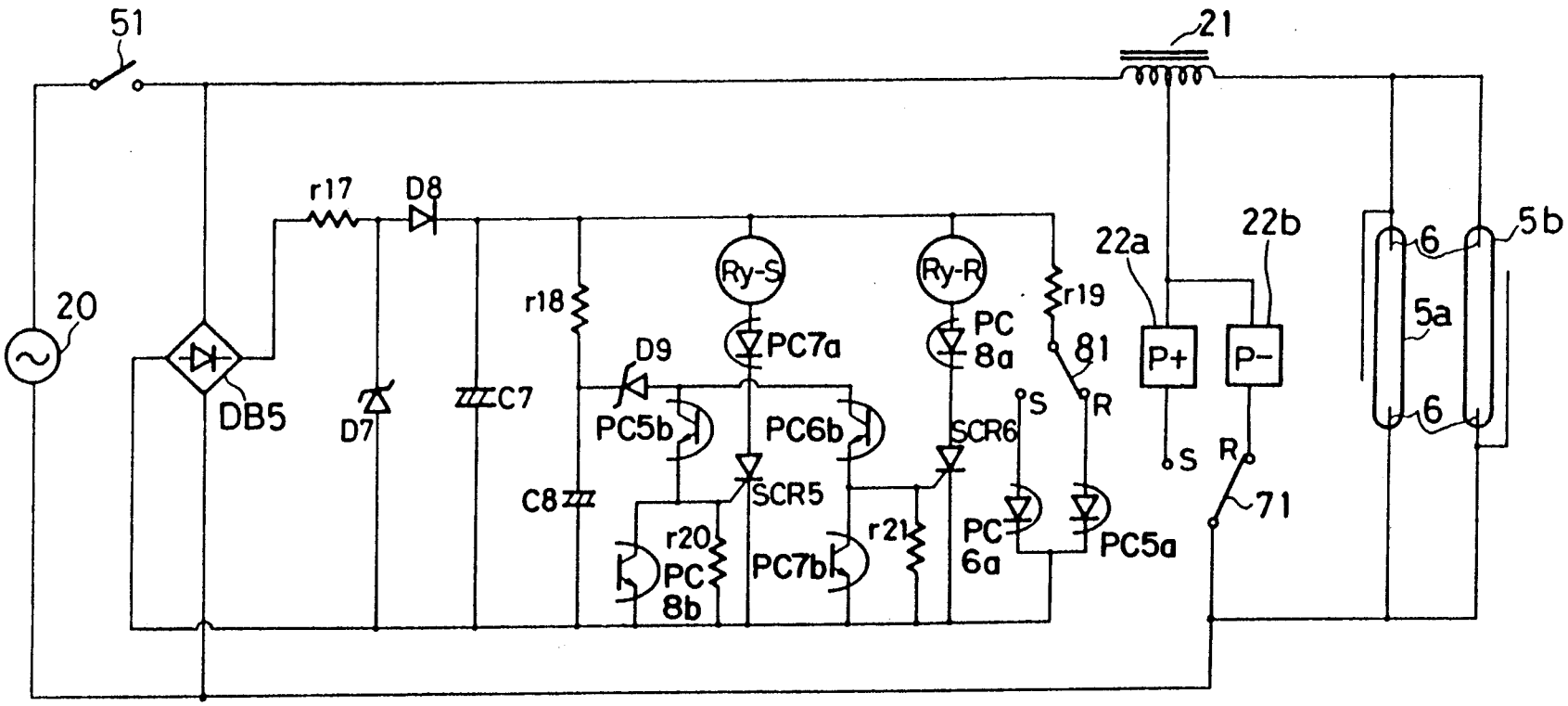
FIG. 12 is a circuit diagram of the operation circuit introduced to the high-pressure discharge lamp according to a fifth embodiment of the present invention.
Figure 13:
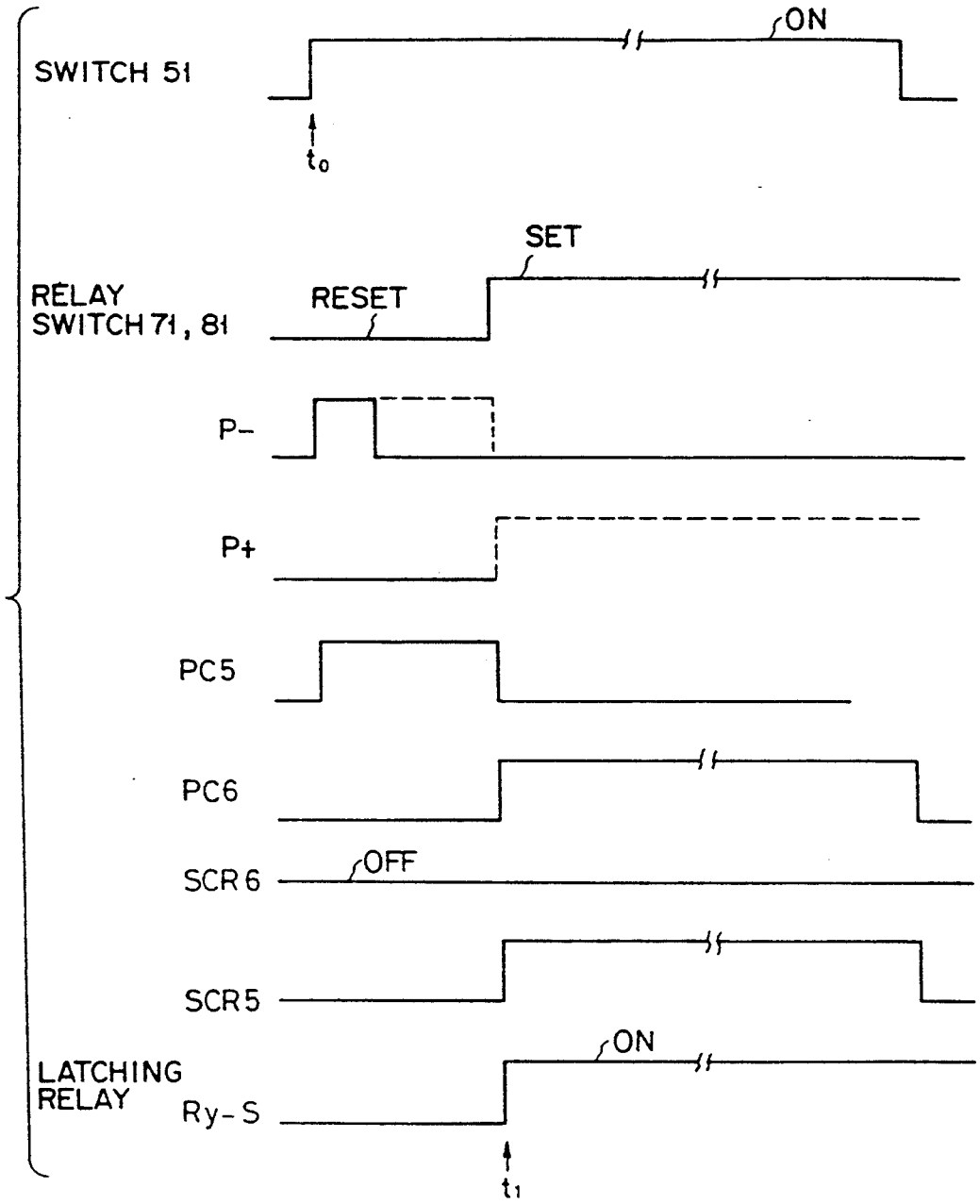
FIG. 13 is a timing diagram explaining the lighting operation according to a fifth embodiment of the present invention.

Referring now to FIGS. 12 and 13, the fifth embodiment of the present invention is described below. Note that the components shown in FIG. 12 which are identical to those shown in FIGS. 4 and 5 are designated by the identical reference numerals, and thus the description of these is deleted here.

Refer to FIG. 12. An input terminal of a diode bridge DB5 is connected to both ends of the AC power-supply source 20 via the power switch 51. A serial circuit consisting of a resistor r17 and a Zener diode D7 is connected to the output terminal of the diode bridge DB5. Another serial circuit consisting of a diode D8 and a capacitor C7 is connected to both ends of the Zener diode D7. Another serial circuit consisting of a resistor r18 and a capacitor C8 is connected to both ends of the capacitor C7. The non-grounded terminal of the capacitor C8 is grounded via a Zener diode D9 and a pair of photocouplers PC5b and PC8b. The anode of the Zener diode D9 is grounded via a pair of photocouplers PC6b and PC7b. Furthermore, a serial circuit consisting of the coil of a latching relay Ry-S, the photocoupler PC7a, and a thyristor SCR5 and another serial circuit consisting of the coil of a latching relay Ry-R, the photocoupler PC8a, and a thyristor SCR6, are respectively connected to both ends of the capacitor C7.

The non-grounded terminal of the capacitor C7 is connected to the movable contact of a relay switch 81 via a resistor r19. Contact S of this relay switch 81 is grounded via the photocouplers PC5a and PC6a. The contact between the photocouplers PC5b and PC8b is grounded via a resistor 20, whereas the non-grounded terminal of the resistor 20 is connected to the gate of the thyristor SCR5. The contact between those photocouplers PC6b and PC7b is grounded via a resistor r21, whereas the non-grounded terminal of the resistor r21 is connected to the gate of the thyristor SCR6.

Next, the functional operation of the control circuit for lighting the high-pressure discharge lamp according to the fifth embodiment of the invention is described below.

First, when the power switch 51 is ON, AC voltage output from the AC power-supply source 20 is superimposed with the negative pulse P2, and then the negative pulse superimposed AC voltage is delivered to both ends of the high-pressure discharge lamp 1 to light up the arc tube 5*a*. When the power switch 51 is ON, AC voltage output from the AC power-supply source 20 is delivered to the diode bridge DB5, which then fully rectifies the waveforms, and the rectified waveforms are then smoothed by a smoothing circuit composed of the resistor r17 and the capacitor C7. After the passing of a predetermined period of time determined by the constant of a circuit consisting of resistor r18, capacitor C8, and the Zener diode D9, a trigger signal is output to the gate of the thyristor SCR5, and as a result, the thyristor SCR5 turns itself ON. This in turn excites the coil of the latching relay Ry-S to switch the relay switches 71 and 81 to come into contact with terminal S, and then this condition is held on.

Since the photocoupler PC7a turns itself ON simultaneous with the excitation of the coil of the latching relay Ry-S, the gate potential of the thyristor SCR6 is grounded via photocoupler PC7b to inhibit the thyristor SCR6 from turning itself ON. As a result, the coil of the latching relay Ry-R is prevented from being excited simultaneously with the excitation of the coil of the latching relay Ry-S. After lighting up the arc tube 5*a*, when the power switch 51 is opened, the arc tube 5*a* again turns itself OFF.

When the power switch 51 is again activated, since the relay switch is closed on the part of the contact S, the positive pulse P2 is superimposed on the AC voltage output from the AC power-supply source 20, and then the positive-pulse superimposed AC voltage is delivered to both ends of the high-pressure discharge lamp 1 to light up the arc tube 5*b*. When the power switch 51 is turned on, AC voltage output from the AC power-supply source 20 is delivered to the diode bridge DB5, which then fully rectifies the waveforms of the received AC voltage. The wave-rectified voltage is then smoothed by a smoothing circuit composing of the resistor r17 and the capacitor C7. Then, after the passing of a predetermined period of time determined by constant of a circuit consisting of the resistor r18, capacitor C8, and the Zener diode D9, a trigger signal is output to the gate of the thyristor SCR6 s that the thyristor SCR6 can be activated. As a result, the coil of the latching relay Ry-R is excited to switch the relay switches 71 and 81 over to the terminal R, and then this condition is held on.

In this way, whenever the power switch 51 is activated, the arc tubes 5*a* and 5*b* alternately light up. As a result, the lighting probability of the arc tubes 5*a* and 5*b* can evenly be levelled off at 50@. This in turn significantly extends the service life of the high-pressure discharge lamp itself. Theoretically, the service life of the electric discharge lamp embodied by the present invention doubles the service life of any conventional high-pressure discharge lamp.

Figure 14:
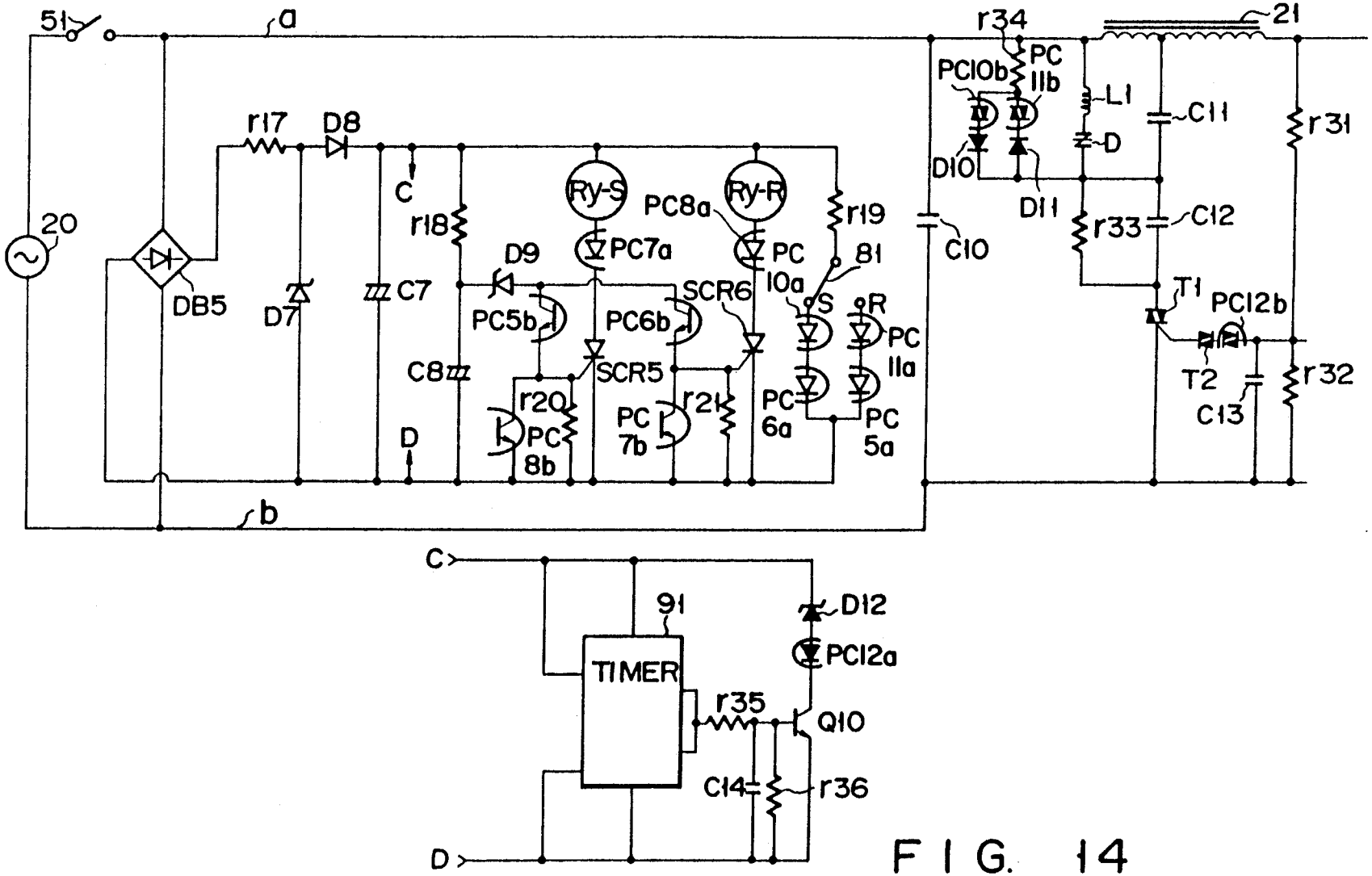
FIG. 14 is a more specific circuit diagram of the operation circuit shown in FIG. 12.

Referring now to FIG. 14, the first variation of the fifth embodiment of the invention is described below. Note that the components shown in FIG. 14 which are identical to those shown in FIG. 12 are respectively designated by the identical reference numerals, and thus, description of these is deleted here. Using the relay switch 71, the control circuit shown in FIG. 12 switches the pulse generators 22*a* and 22*b* as required. The control circuit according to the first variation of the first embodiment switches the positive and negative pulses by applying the photocouplers PC10a, PC10b, PC11a and PC11b.

In FIG. 14, a power-factor adjusting capacitor C10 is provided between power-supply lines "a" and "b" connected to both ends of the AC power-supply source 20. A serial circuit comprised of the ballast 21 and the resistors r31 and r32 is connected to the power-factor adjusting capacitor C10. The outer envelope 1 housing a pair of arc tubes 5*a* and 5*b* is connected to both ends of the serial circuit comprising resistors r31 and r32.

The intermediate point of the ballast 21 is connected to the power-supply line "b" via capacitors C11 and C12 and a constantly closed triode AC switch T1. An inductance coil L1 and a two-way-two-pin thyristor D are respectively connected to an end of the ballast 21 and the other end of the capacitor C11. A resistor r33 is connected to both ends of the capacitor C12. In addition, a resistor r34, the photocoupler PC11b and a diode D11 (which is connected in the forward direction) are respectively connected to both ends of a serially connected circuit composed of the inductance coil L1 and the thyristor D. The diode D11 (which is connected in the direction inverse from the photocoupler PC11b) is connected to a serially connected circuit composed of the photocoupler PC10b and the diode D10.

A capacitor C13 is connected to both ends of the resistor r32. The contact between the resistors r31 and r32 is connected to the triode AC switch T1 via the photocoupler PC12b and another triode AC switch T2.

Both ends (points C and D) of the capacitor C7 are connected to a timer 91. The output terminal of the timer 91 is connected to the base of a transistor Q10 via a resistor r35. An inversely connected diode D12 and a photocoupler PC12a are respectively connected between the collector of the transistor Q10 and the point C. A capacitor C14 and a resistor r36 are connected in parallel with each other between the base and the emitter of the transistor Q10. After passing a predetermined period of time from the operating of the power switch 51, the transistor Q10 is activated by the timer 91.

The photocoupler PC10a is connected between contact S of a relay switch 81 and the photocoupler PC6a. The photocoupler PC11a is connected between contact R of the relay switch 81 and the photocoupler PC5a.

When the power switch 51 is activated while the relay switch 81 is closed on the part of the contact S, the photocoupler PC10b turns itself ON via photocoupler PC10a. As a result, the capacitor C11 is charged with specific voltage during a period in which the voltage flowing through the line "b" is higher than that which flows through the other line "a". As soon as the charged voltage rises beyond the breakdown voltage of the thyristor D, the capacitor C11 discharges it to cause the negative pulse to superimpose on the AC power voltage.

On the other hand, when the power switch 51 is activated while the relay switch 81 is closed on the part of the contact R, then, the photocoupler PC11b turns itself ON via photocoupler PC11b. As a result, the capacitor C11 is charged with specific voltage during a period in which the voltage flowing through the line "a" is higher than that which flows through the other line "b". As soon as the charged voltage rises beyond the breakdown voltage of the thyristor D, the capacitor C11 discharges it to cause the positive pulse to superimpose on the AC power voltage.

After a predetermined period of time has past from the operation of the power switch 51, the transistor Q10 turns itself ON to cause the photocoupler PC12b to also turn ON via photocoupler PC12a, and as a result, the triode AC switch T1 is no longer conductive. As a result, after a predetermined period of time has past after the operation of the power switch 51, the ignition pulse cannot superimpose on the AC power voltage output from the AC power-supply source 20 at all.

Figure 15:
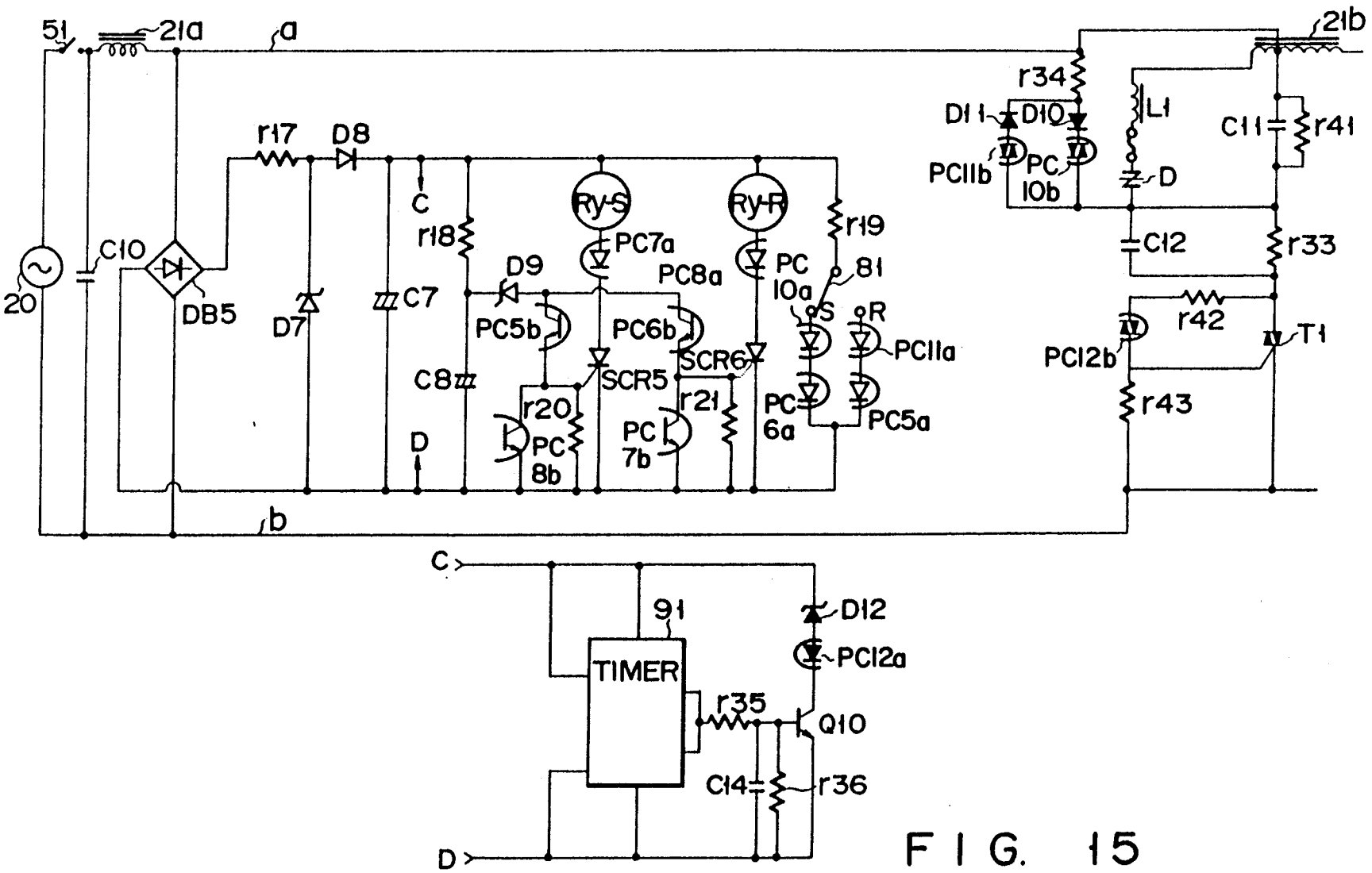
FIG. 15 is a diagram of a variation of the operation circuit of a fifth embodiment.

Referring now to FIG. 15, the second variation of the fifth embodiment of the present invention is described below. Note that the components shown in FIG. 15 which are identical to those shown in FIGS. 12 and 14 are respectively designated by the identical numerals, and thus, the description of these is deleted here. To implement the second variation, the line "a" connected to an end of the AC power-supply source 20 is provided with a pair of ballasts including the mein ballast 21*a* and an auxiliary ballast 21*b* by dividing the stabilizer 21 into two parts. The line "a" is connected to the intermediate point of the auxiliary ballast 21*b*. A parallel connected circuit composed of a capacitor C11 and a resistor r41, another parallel connected circuit composed of a capacitor C12 and a resistor r33, and a triode AC switch T1, are respectively connected between the intermediate point of the auxiliary ballast 21*b* and the line "b". A resistor r42, a photocoupler PC12b, and a resistor r43, are respectively connected to both ends of the triode AC switch T1, and in addition, contact between the photocoupler PC12b and the resistor r43 is also connected to the gate of the triode AC switch T1.

By virtue of the above arrangement, conductivity of the triode AC switch T1 is restrained for a predetermined period of time after turning the power switch 51 ON. As shown in FIG. 15, if the relay switch 81 were closed on the part of contact S when the power switch 51 is turned ON, as was done for the first variation of the fifth embodiment, the negative pulse superimposes on the AC voltage output from the AC power-supply source 20. On the other hand, if the relay switch 81 were closed on the part of the other contact R when the power switch 51 is turned ON, then, as was done for the first variation described above, the positive pulse superimpose on the AC voltage output form the AC power-supply source 20.

Furthermore, since the second variation of the fifth embodiment discretely provides the main ballast 21*a* and the auxiliary ballast 21*b*, these ballasts can effectively minimize attenuation of the positive or negative pulse.

Figure 16:
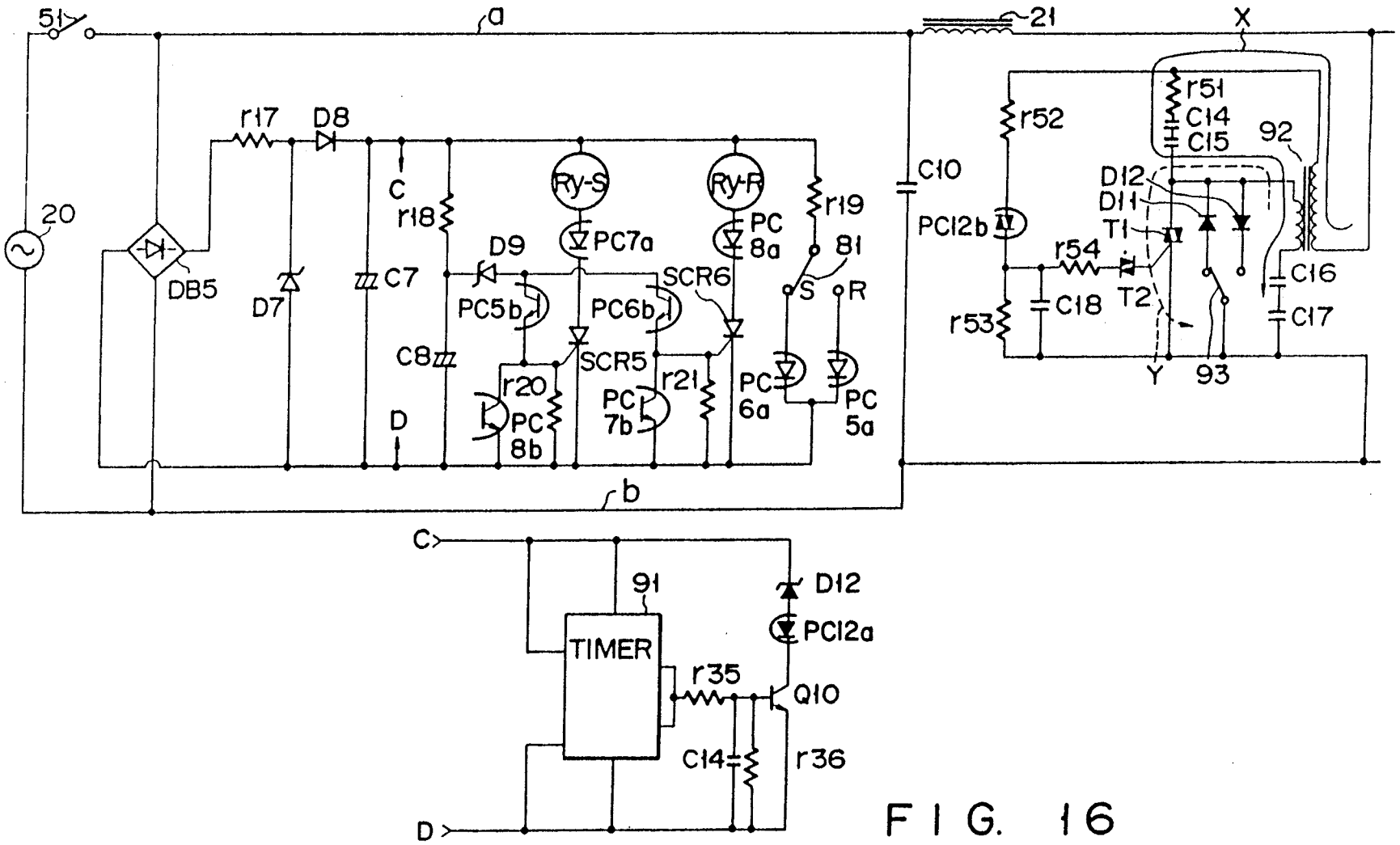
FIG. 16 is a circuit diagram of another variation of the operation circuit of a fifth embodiment.

Referring now to FIG. 16, the third variation of the fifth embodiment of the present invention is described below. Note that the components shown in FIG. 16 which are identical to those shown in FIGS. 12, 14 and 15, are respectively designated by the identical reference numerals, and thus, description of these is deleted here.

See FIG. 16. A power-factor adjusting capacitor C10 is connected between lines "a" and "b" connected to both ends of the AC power-supply source 20. A stabilizer 21, the secondary coil of a pulse transformer 92, a resistor r51, a pair of capacitors C14 and C15, and a constantly open triode AC switch T1, are respectively connected to both ends of the capacitor C10 in series. Furthermore, the primary coil of the pulse transformer 92, and a pair of capacitors C16 and C17, are respectively connected to both ends of the triode AC switch T1.

Furthermore, owing to switching operation of a relay switch 93, either of those diodes D11 and D12 (which are respectively connected in the direction inverse from each other) can selectively be connected to both ends of the triode AC switch T1 in parallel.

Furthermore, a resistor r52, a photocoupler PC12b, and a resistor r53, are respectively connected between an end of the resistor r51 and the other end of the triode AC switch T1. A capacitor C18 is connected to both ends of the resistor r53. Contact between the photocoupler PC12b and the resistor r53 is connected to the triode AC switch T1 via a resistor r54 and another triode AC switch T2.

By virtue of the above structure, if the relay switch 93 were at the switched position shown to the right of FIG. 16 after activating the power switch 51, if the voltage flowing through the line "a" rises beyond the voltage flowing through the other line "b", the voltage of the line "a" flows into those capacitors C14 through C17 via the arrowed route X. Then, when the photocoupler PC12b turns ON after passing a predetermined period of time from the operating of the power switch 51, the triode AC switch T1 also turns itself ON. As a result, a discharge circuit like the one shown with broken line is formed to cause the positive pulse to superimpose on the AC voltage output from the AC power-supply source 20.

On the other hand, while the relay switch 93 is closed in the direction opposite from the position shown in FIG. 16, if the voltage flowing through the line "b" rises beyond the voltage flowing through the other line "a", it flows in the direction opposite from the arrowed direction X to effect charge. When the photocoupler PC12b turns ON after a predetermined period of time has past after the operation of the power switch 51, the triode AC switch T1 also turns ON, thus forming a discharge circuit in the direction opposite from broken line Y to cause the negative pulses to superimpose themselves on the AC voltage delivered from the AC power-supply source 20.

Figure 17:
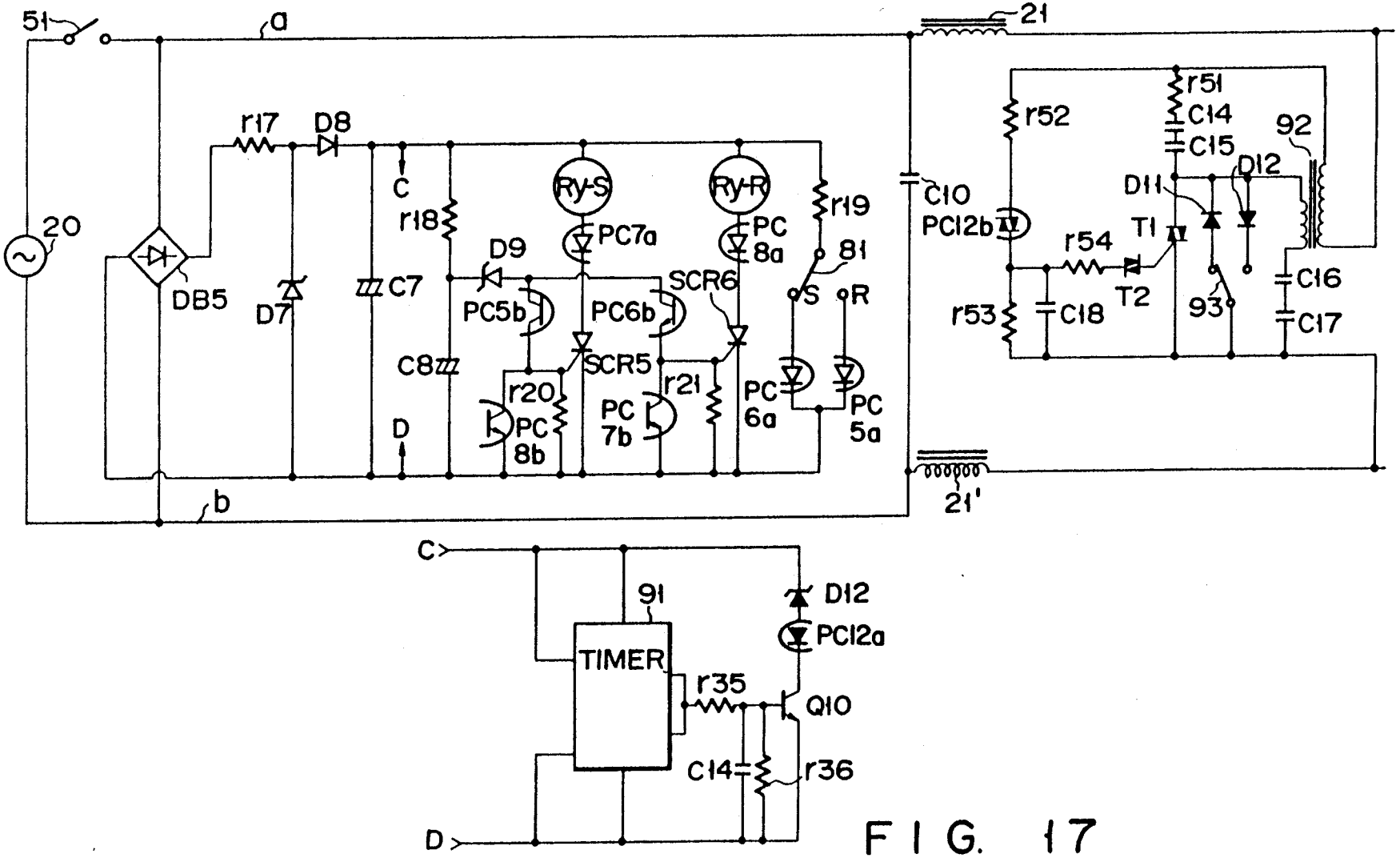
FIG. 17 is a circuit diagram of further variation of the operation circuit of a fifth embodiment.

Although the control circuit shown in FIG. 16 solely provides the ballast 21 for the line "a", as shown in FIG. 17, another ballast 21 having performance characteristic identical to that of the ballast 21 may be provided for the line "b". This permits the control circuit to more securely switch the arc tubes 5*a* and 5*b* to light up.

Figure 18:
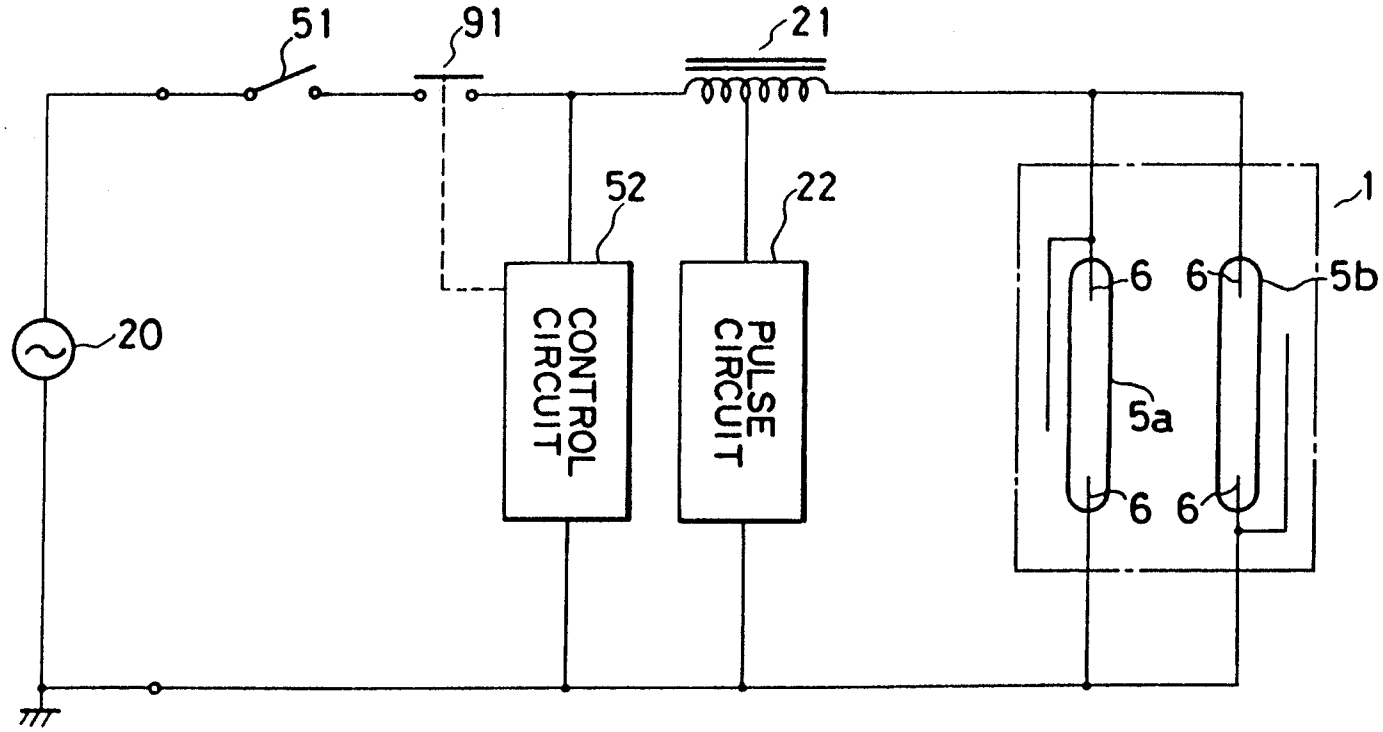
FIG. 18 is a schematic block diagram of the operation circuit of the high-pressure discharge lamp according to a sixth embodiment of the present invention.

Referring now to FIG. 18, the sixth embodiment of the invention is described below. Note that the components shown in FIG. 18 which are identical to those shown in FIG. 4 are respectively designated by the identical reference numerals, and thus, the description of these is deleted here. The reference numeral 20 designates the AC power-supply source. Both ends of this AC power-supply source 20 are connected to the high-pressure discharge lamp 1 via the power switch 51, control switch 91, and the ballast 21. An end of a control circuit 52 is connected to the contact between the control switch 91 and the ballast 21, and the other end is grounded. An end of a pulse circuit 22 is connected to the intermediate point of the ballast 21, and the other end is grounded. In addition to the functional features described in relation to those structures shown in FIGS. 4 and 5, the control circuit 52 incorporates a function to open and close the control switch 91 at predetermined intervals.

Owing to the structure mentioned above, the control circuit can effectively prevent the arc tube 5*a* from continuously being lit otherwise caused by the closed state of the power switch 51 after being turned ON. More particularly, when detecting that a predetermined period of time is past after the power switch 51 is ON, the control circuit 52 opens the control switch 91, and then closes it. As a result, this simulates the opening and closing operation of the power switch 51 to cause the other arc tube 5*b* to light up so that the lighting probability can evenly be levelled off at 50%.

When applying a large number of high-pressure discharge lamps each incorporating a plurality of arc tubes to the illumination of highways in tunnels without turning the power switch 51 OFF at all, the control system according to the sixth embodiment of the invention can securely maintain the lighting probability of each arc tube substantially at 50%. Since the simultaneous extinction of a plurality of high-pressure discharge lamps endangers the traffic safety, it is desired that the high-pressure discharge lamps illuminating highways in tunnels are sequentially switched on an individual or group basis with the delayed timing. Using a remote-controlled monitorinq system, operations of the control switch 91 can properly be managed.

Figure 19:
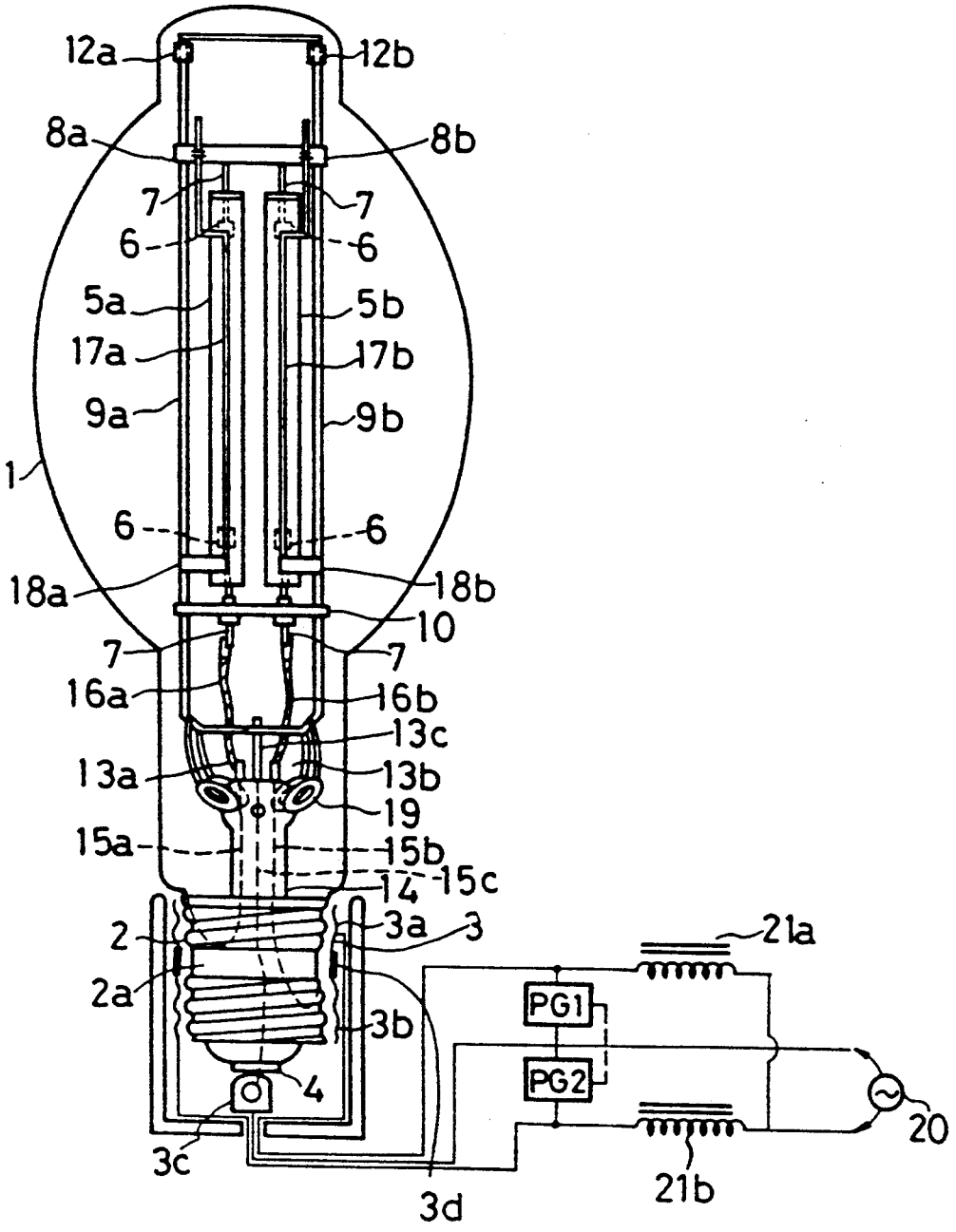
FIG. 19 is a schematic diagram of the high-pressure discharge lamp according to a seventh embodiment of the present invention in conjunction with the operation circuit.
Figure 20A:
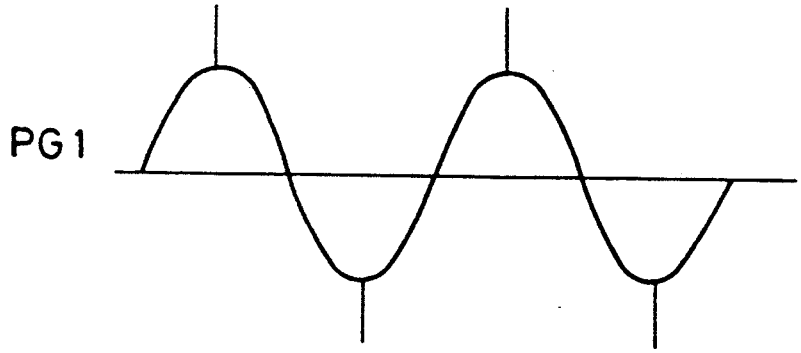
FIG. 20A is a diagram showing the waveform output from a pulse-generating circuit PG1 introduced to a seventh embodiment of the present invention.
Figure 20B:
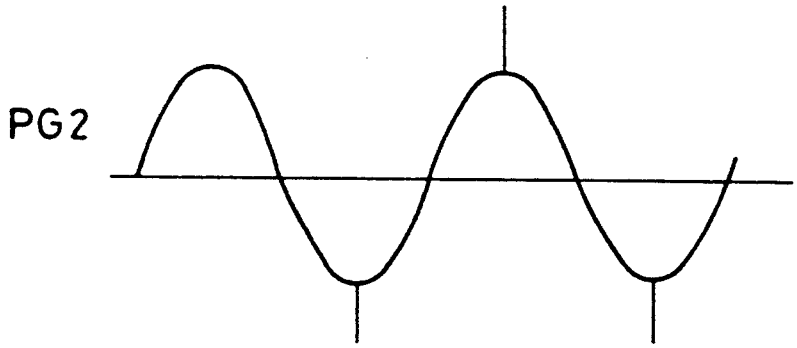
FIG. 20B is a diagram showing the waveform output from a pulse-generating circuit PG2 introduced to a seventh embodiment of the present invention.

Referring now to FIGS. 19 and 20, the high-pressure discharge lamp according to the seventh embodiment of the present invention is described below. Note that the components shown in FIG. 19 which are identical to those shown in FIG. 1 are respectively designated by the identical reference numerals, and thus, description of these is deleted here.

See FIG. 19. A conductive member 7 below the arc tube 5*a* is connected to a shield-supporting line 13*a* via a lead wire 16*a*, whereas the other conductive member 7 below the other arc tube 5*b* is connected to the other shield-supporting line 13*b* via a lead wire 16*b*. A connecting member connecting the bottom end of a pair of supporting wires 9*a* and 9*b* is bonded to a shield-supporting line 13*c* by means of welding. These shield-supporting lines 13*a* through 13*c* are airtightly connected to a stem 14 of the outer envelope 1.

The shield-supporting line 13*a* is connected to one side of a screw base 2 by an external conductor 15*a*, where the screw base 2 has a pair of metallic members which are electrically insulated across a screw base insulator 2a. The shield-supporting line 13b is connected to the other side of the screw base 2 by an external conductor 15b, whereas the other shield-supporting line 13c is connected to an eye-let terminal 4 by an external conductor 15c.

A socket insulator 3a is provided on the internal circumferential surface of a socket 3 which is engaged with the screw base 2 and faces the screw base insulator 2a. The socket 3 itself has a pair of metallic members 3a and 3b which are electrically insulated from each other across the socket insulator 3a. These metallic members 3a and 3b are respectively connected to an end of the AC power-supply source 20 via ballasts 21a and 21b. Contact 3c coming into contact with the eyelet terminal 4 is connected to the other end of the AC power-supply source 20. Pulse generators PG1 and PG2 are respectively connected between the other end of the AC power-supply source 20 and the lines connected to those ballasts 21a and 21b. These pulse generators PG1 and PG2 respectively output ignition pulses in response to the phase of received voltage. These pulse generators PG1 and PG2 respectively start to generate the ignition pulses when the phase of the input voltage inverts. For example, as shown in FIG. 20A, the pulse generator PG1 starts to generate the ignition pulses when the positive-phase voltage is received. On the other hand, the pulse generator PG2 starts to generate the ignition pulses when the negative-phase voltage is received. For example, when the power switch 51 is activated, if the positive-phase voltage were delivered to the pulse generator PG1 as shown in FIG. 20A, then, the pulse generator PG1 initially starts to generate the ignition pulses to cause the arc tube 5a to light up first. On the other hand, if the negative-phase voltage were delivered to the pulse generator PG2 when the power switch 51 is activated, then, the pulse generator PG2 initially starts to generate the ignition voltage, and as a result, the arc tube 5b lights up first.

Since there is 50% of probability to feed either the positive-phase voltage or the negative-phase voltage to the pulse generators PG1 and PG2, these arc tubes 5a and 5b can respectively be operated at 50% of probability.

The lighting probability is levelled off relative to the increased lighting rounds, and thus, neither of the arc tubes 5a and 5b can unilaterally and intensively be lit up. This in turn prevents either of these arc tubes from being lit up more frequently than the other, and thus, the voltage in the lamp can be prevented from rising as a result of the promoted dissipation of sodium in either of the arc tubes 5a and 5b. As a result, neither of these arc tubes quickly degrades its own arc characteristic. Substantially, the service life of the high-pressure discharge lamp embodied by the present invention doubles that of any conventional high-pressure discharge lamp merely incorporating a single arc tube.

Furthermore, when either of these arc tubes goes OFF while being lit as a result of a momentary power interruption and the power service is restored, then the other arc tube containing low pressure and thus far having remained OFF lights up. In this case, the latter arc tube were preliminarily heated while the former arc tube remained lit, and yet, since the pressure inside of the latter arc tube is slightly up, the lighting condition can quickly be stabilized. In other words, the high-pressure discharge lamp embodied by the invention can be reactivated in an extremely short period of time to restore the predetermined luminosity. If a plurality of the high-pressure discharge lamps embodied by the invention were made available for the illumination of highways and tunnels, traffic safety can significantly be promoted.

Furthermore, the control circuit according to the seventh embodiment can simultaneously light up the arc tubes 5a and 5b by effectively controlling those pulse generator PG1 and PG2, thus making the luminosity double.

The above description on the seventh embodiment has solely referred to the system for controlling the illumination of the high-pressure discharge lamp 1 incorporating a pair of arc tubes 5a and 5b. If more than two of arc tubes 5a, 5b, . . . 5n were stored in the high-pressure discharge lamp 1, operation for lighting these arc tubes is subject to control by applying the control system of the eighth embodiment of the present invention shown in FIG. 21.

Figure 21:
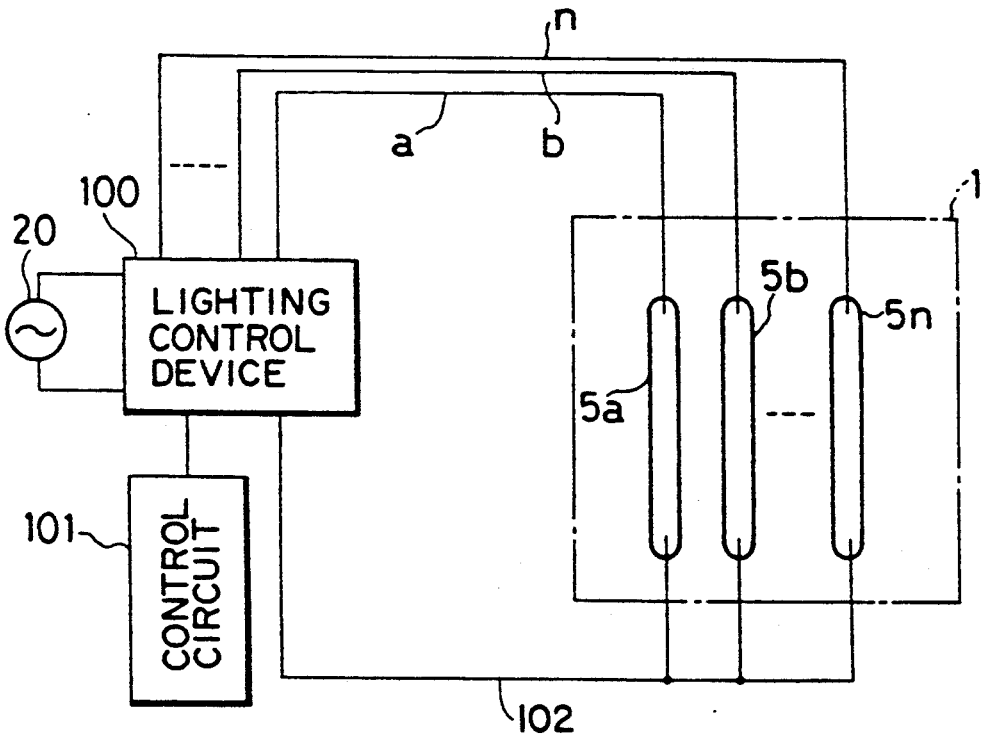
FIG. 21 is a schematic block diagram of the operation circuit of the high-pressure discharge lamp according to an eighth embodiment of the present invention.

See FIG. 21. The AC power-supply source 20 is connected to a lighting control device 100. A control circuit 101 is connected to this lighting control device 100. The lighting control device 100 is connected to one end of terminals 6 of the arc tubes 5a through 5n via power transmission lines "a" through "n", and yet, the lighting control device 100 is also connected to the other end of terminals 6 of those arc tubes 5a through 5n via another line 102.

In response to the control signal from the control circuit 101, the lighting control device 100 superimposes either the positive pulse P1 or the negative pulse P2 on the AC voltage from the AC power-supply source 20, and then delivers the pulse-superimposed AC voltage to a specific power transmission line selected from the lines "a" through "n" before selectively lighting up any of the arc tubes 5a through 5n.

For example, the light control device 100 divides the arc tubes 5a through 5n into two groups in order to evenly level off the lighting probability of both arc tube groups substantially at 50% whenever activating the power switch (not shown).

Next, referring to FIGS. 22A, 22B, 23 and 24, the ninth embodiment of the present invention is described below. Although not Shown in FIGS. 22A and 22B, the outer envelope stores a pair of frosted arc tubes 5a and 5b by way of inclining them by about 10 degrees part from the vertical line so that the tubular axes can intersect themselves at this angle.

These frosted arc tubes 5a and 5n are respectively of the structure comprising a pair of end disks made from niobium, which is provided by way of shielding both ends of each tubular bulb composed of a ceramic tube made from either polycrystalline or monocrystalline alumina and airtightly bonded to both ends of the tubular bulb. Each of the end disks internally secures main terminals 6 at the upper and lower regions. The terminals 6 are respectively connected to the corresponding conductive members 7 projecting themselves from the end disks. The arc tubes 5a and 5b airtightly contain sodium, mercury, and Xenon gas, respectively.

Figure 22A:
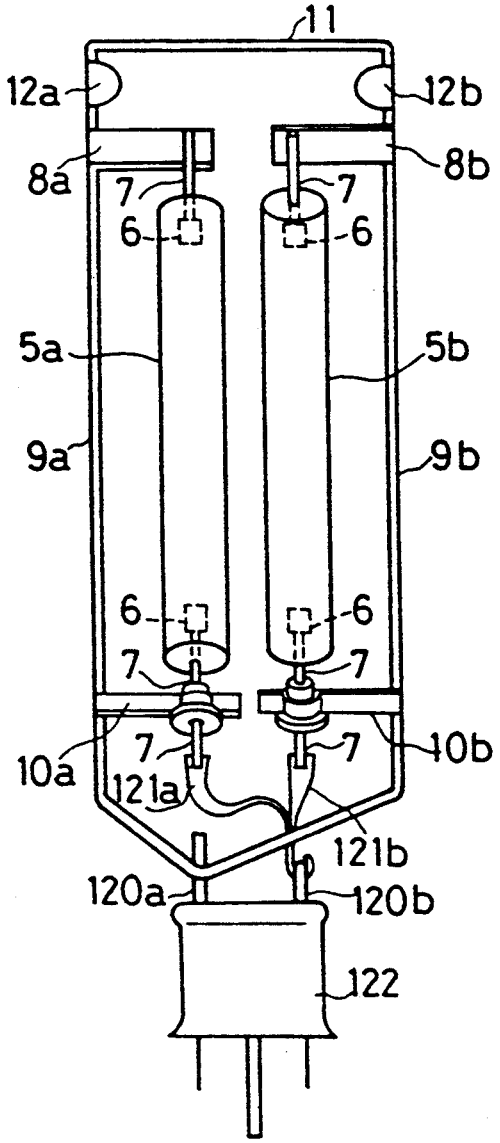
FIG. 22A is a schematic diagram of the front view of the high-pressure discharge lamp according to a ninth embodiment of the present invention.
Figure 22B:
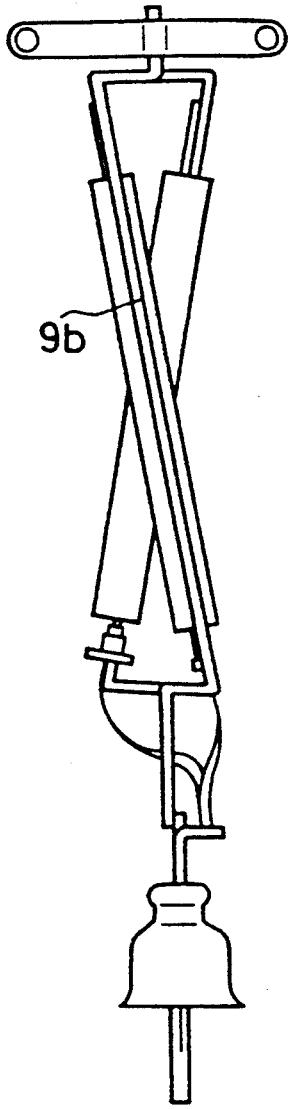
FIG. 22B is a schematic diagram of the lateral view of the high-pressure discharge lamp according to a ninth embodiment of the present invention.

The upper conductive members 7 shown in FIG. 22A are electrically and mechanically connected to a pair of bulb holders 8a and 8b made from a thermally resistant metal like niobium or tantalum. Both ends of the bulb holders 8a and 8b are respectively coupled with supporting wires 9a and 9b.

The lower conductive members 7 shown in FIG. 22A are respectively held by insulated holders 10a and 10b, where both ends of the insulated holders 10a and 10b are respectively supported by the supporting wires 9a and 9b.

Substantially, the supporting wires 9a and 9b are conductive. The upper ends of these supporting wires 9a and 9bare interconnected via an insulated bridge 11. The upper ends of these supporting wires 9a and 9b are respectively engages the top region of the outer envelope via a pair of elastic plates 12a and 12b. The bottom ends of these supporting wires 9a and 9b are bonded to an inner lead wire 120a by means of welding.

The conductive members 7 below the arc tubes 5a and 5b are respectively connected to an inner lead wire 120b via a pair of silver lead wires 121a and 121b for example. The inner lead wires 120a and 120b are supported by the stem 122 of the outer envelope.

According to the ninth embodiment of the present invention, since a pair of arc tubes 5a and 5b stored in the outer envelope are respectively frosted, and yet, since the axes of these arc tubes 5a and 5b intersect with each other by about 10 degrees, the system can minimize the unwanted rate of obliging light from a radiant tube to be shielded by the other extinct tube. FIG. 24 is a chart of the unevenness of light distribution when the arc tubes 5a and 5b cross each other and align themselves in parallel with each other. The table shown in FIG. 24 shows the comparative unevenness of light distribution right below the illuminator when the extinct arc tube is at a position 180 degrees apart from the illuminated arc tube which is at the 0 degree position.

Figure 23:
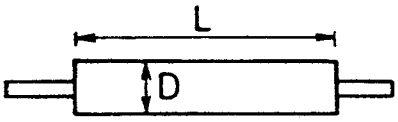
FIG. 23 is a diagram showing the dimensions of the arc tubes according to a ninth embodiment of the present invention.

As shown in FIG. 23, assume that the external diameter of each arc tube is D and the length L, and yet, the interval between the arc tube 5a and 5b is less than 3D/2 and the intersecting angle $\theta$. If the intersecting angle $\frac{1}{4}$ were set in a range $D/3L \leqq \sin\theta < 2D/L$, then these arc tubes 5a and 5b can maintain a satisfactory proportion of light distribution.

Figure 25:
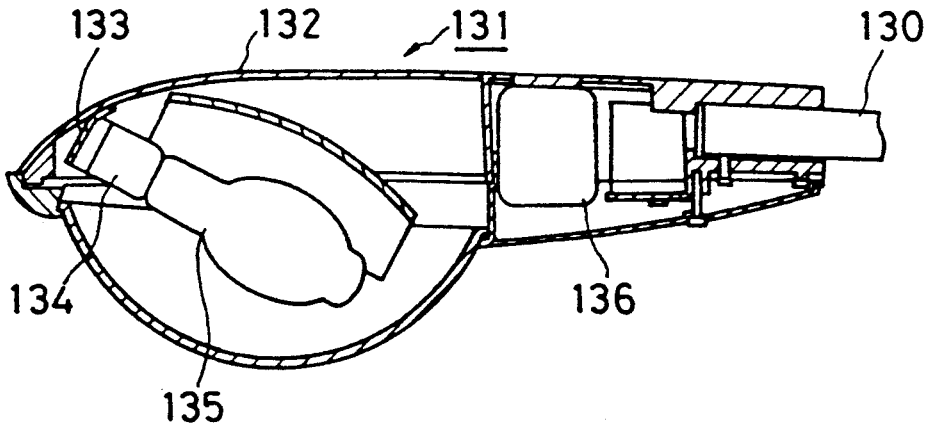
FIG. 25 is a sectional view of an illumination instrument according to a tenth embodiment of the present invention.
Figure 26:
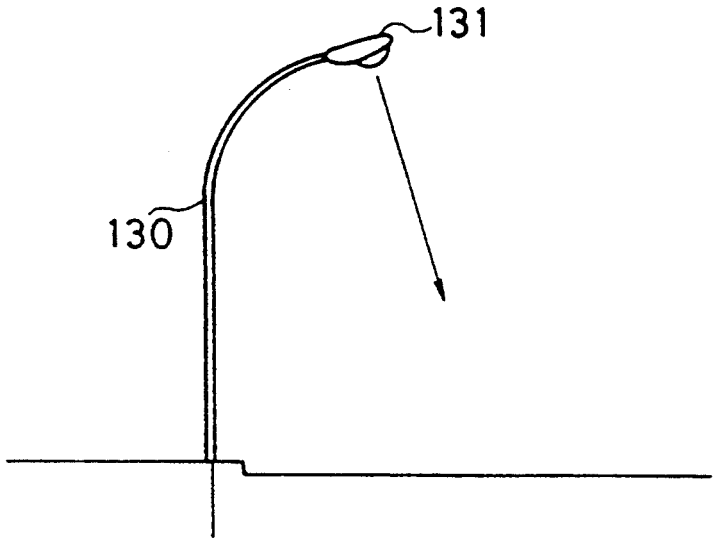
FIG. 26 is a lateral view of the illumination instrument showing the method of installing it according to a tenth embodiment of the present invention.

Next, referring to FIGS. 25 and 26, the tenth embodiment of the present invention is described below. FIG. 25 is a sectional view of an illuminator housing a high-pressure discharge lamp incorporating a pair of arc tubes like the one shown in FIG. 1. FIG. 26 is a perspective view of an illuminator installed on a road. The reference numeral 130 shown in FIGS. 25 and 26 represents a pole erected on a side of a road. An illuminator 131 is supported to the top of the pole 130. A socket 134 is supported to a flange 133 inside of the back plate 132 of the illuminator 131. The socket 134 accommodates a high-pressure discharge lamp 135. The illuminator 131 incorporates a lighting control device 136 which lights up a pair of arc tubes stored in the high-pressure discharge lamp based on a substantially even probability. The lighting control device 136 incorporates the electrical circuits described earlier in the preceding embodiments. The lighting Control device 136 may discretely be provided outside of the illuminator 131.

In this way, the application of the high-pressure discharge lamp housing a pair of arc tubes as per the embodiments of the invention to the illumination of roads and tunnels is quite useful. Since the high-pressure discharge lamp embodied by the invention securely prevents either one of the arc tubes from unilaterally and more frequently being activated, and the actual service life doubles that of any conventional high-pressure discharge lamp merely housing a single arc tube.

The above description has solely referred to the high-pressure discharge lamp incorporating a pair of arc tubes. However, the scope of the invention is not merely confined to the use of a pair of arc tubes, but the high-pressure discharge lamp of the invention may also store more than two of arc tubes, and yet, the lighting probability of these arc tubes can evenly be levelled off substantially at 50%.

Furthermore, the ignition aids 17a and 17b may not necessarily be provided outside of those arc tubes 5a and 5b. Furthermore, when implementing any of the embodiments described above, a pair of ballasts may be provided as per the embodiment shown in FIG. 21. Additional advantages and modifications will readily occur to those skilled in the art. Therefore, the invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A high-pressure discharge lamp comprising: an outer envelope of light-translucent material;

a plurality of arc tubes enclosed in said outer envelope and electrically connected in parallel with each other;

a plurality of ignition aids available for assisting operation of respective arc tubes, wherein said ignition aids are at different electrical potentials; and a high-voltage pulse generating means for supplying a high voltage pulse to said ignition aids, said high voltage pulse generating means being housed in said outer envelope and comprising a thermal reaction switch and a heater for heating said thermal switch, both said switch and said heater being connected in series.

2. A high-pressure discharge lamp comprising:

an outer envelope of light-translucent material;

a plurality of arc tubes enclosed in said outer envelope and electrically connected in parallel with each other; and a plurality of ignition aids available for assisting operating of respective arc tubes, wherein said ignition aids are at different electrical potentials, and wherein said plurality of arc tubes have longitudinal axes and are disposed within said outer envelope such that said longitudinal axes form an angle with respect to one another.

3. An apparatus for operating a high-pressure discharge lamp comprising:

an outer envelope incorporating a pair of electric terminals;

a high-pressure discharge lamp comprising said outer envelope incorporating a pair of electric terminals, a plurality of arc tubes enclosed in said outer envelope and electrically connected to said pair of terminals in parallel, and a plurality of ignition aids for assisting operation of respective arc tubes, wherein said arc tubes have different electrical potentials;

an AC power supply source for supplying an AC voltage;

first and second power-supply means respectively connecting both terminals of said AC power supply source to said pair of terminals;

a ballast being at least connected on either of said first and second power supply means;

a pulse generating means generating at least positive or negative ignition pulses for superimposing on said AC voltage delivered from said AC power supply source; and a control means for selecting either positive or negative ignition pulses output from said pulse generating means for superimposing on said AC voltage.

* * * * *